US006787299B2

(12) United States Patent
Yamashita et al.

(10) Patent No.: US 6,787,299 B2
(45) Date of Patent: Sep. 7, 2004

(54) SILVER SALT PHOTOTHERMOGRAPHIC IMAGING MATERIAL

(75) Inventors: Hirobumi Yamashita, Hino (JP); Toshihisa Takeyama, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/338,271

(22) Filed: Jan. 8, 2003

(65) Prior Publication Data

US 2003/0175630 A1 Sep. 18, 2003

(30) Foreign Application Priority Data

Jan. 16, 2002 (JP) ..... P2002-007314

(51) Int. Cl.[7] ..... G03C 1/498; G03C 1/60

(52) U.S. Cl. ..... 430/619; 430/264; 430/598; 430/621; 430/622; 430/623; 430/626; 430/627

(58) Field of Search ..... 430/619, 264, 430/626, 630, 627, 623, 598, 620, 621, 622

(56) References Cited

U.S. PATENT DOCUMENTS 6,297,001 B1 10/2001 Takiguchi et al. ..... 430/619
6,319,657 B1 11/2001 Hirabayashi ..... 430/350

*Primary Examiner*—Thorl Chea
(74) *Attorney, Agent, or Firm*—Muserlian, Lucas and Mercanti

(57) ABSTRACT

A silver salt photothermographic imaging material is disclosed, comprising a light-sensitive aliphatic acid silver salt, a light-sensitive emulsion containing light-sensitive halide grains, a reducing agent for silver ions, a binder and a cross-linking agent, wherein the cross-linking agent is an aromatic polyisocyanate compound and the photothermographic material further comprises a compound selected from compounds represented by the following formulas.

10 Claims, No Drawings

SILVER SALT PHOTOTHERMOGRAPHIC IMAGING MATERIAL

FIELD OF THE INVENTION

The present invention relates to silver salt photothermographic dry imaging materials (hereinafter, also denoted simply as photothermographic materials or light sensitive materials), and an image recording method-and image forming method by the use thereof.

BACKGROUND OF THE INVENTION

In the field of graphic arts and medical treatment, there have been concerns in processing of photographic film with respect to effluents produced from wet-processing of image forming materials, and recently, reduction of the processing effluent is strongly demanded in terms of environmental protection and space saving. There has been desired a photothermographic material for photographic use, capable of forming distinct black images exhibiting high sharpness, enabling efficient exposure by means of a laser imager or a laser image setter.

Known as such a technique is a thermally developable photothermographic material which comprises on a support an aliphatic carboxylic acid silver salt, light sensitive silver halide grains, and reducing agent, as described in U.S. Pat. Nos. 3,152,904 and 3,487,075, and D. Morgan, "Dry Silver Photographic Materials" (Handbook of Imaging Materials, Marcel Dekker, Inc. page 48, 1991). In such photothermographic materials, no solution type processing chemicals is used, providing a simple and environment friendly system to users.

There was proposed a photothermographic material containing compounds, so-called a contrast-increasing agent or silver-saving agent, thereby achieving higher densities based on silver coverage per unit area, compared to photothermographic materials not containing such compounds.

Such photothermographic materials are described in U.S. Pat. Nos. 5,496,695, 5,545,505, 5,545,507, 5,637,449, 5,654,130, 5,635,339, 5,545,515, 5,686,228; JP-A Nos. 10-339929, 11-84576, 11-95365, 11-95366, 11-109546, 11-119372, 11-119373, 2000-356834 and 2001-27790 (hereinafter, the term, JP-A is referred to as unexamined Japanese Patent Application publication), in which a various kinds of contrast-increasing agents and silver-saving agents were proposed.

However, problems arose with photothermographic materials containing such a silver-saving agent that, depending of pre-exposure storage conditions, densities in unexposed areas are different after being processed and an intended density (for example, maximum density) could not be achieved. Furthermore, there were problems involved in fogging.

SUMMARY OF THE INVENTION

The present invention was realized in light of the foregoing problems. Thus, it is an object of the invention to a silver salt photothermographic dry imaging material exhibiting an enhanced maximum density (Dmax), reduced fogging and superior storage stability, and an image recording method and image forming method by use thereof.

The foregoing object of the invention can be accomplished by the following constitution:

1. A silver salt photothermographic imaging material comprising a light-insensitive aliphatic carboxylic acid silver salt, a light-sensitive emulsion containing light-sensitive silver halide, a reducing agent for silver ions, a binder and one or more cross-linking agents, wherein at least one of the cross-linking agents is an aromatic polyisocyanate compound and the photothermographic material further comprises a compound selected from compounds represented by the following formulas (1) through (3):

formula (1)

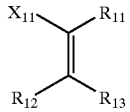

wherein $R_{11}$, $R_{12}$ and $R_{13}$ are each a hydrogen atom or a univalent substituent; $X_{11}$ is an electron-donating heterocyclic group, a cycloalkyloxy group, a cycloalkylthio group, a cycloalkylamino group or cycloalkenyl group;

formula (2)

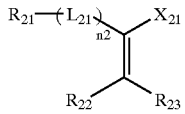

wherein $R_{21}$ is an alkyl group; $R_{22}$ and $R_{23}$ are each a hydrogen atom or a univalent substituent; $X_{21}$ is an electron-withdrawing group; $L_{21}$ is an aromatic carbon-ring group; and n2 is 0 or 1;

formula (3)

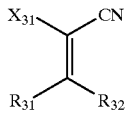

wherein $X_{31}$ is an electron-withdrawing heterocyclic moiety, a halogen atom or a haloalkyl group; one of $R_{31}$ and $R_{32}$ is a hydrogen atom and the other one is a hydroxy group.

2. The photothermographic imaging material described in 1., wherein $R_{11}$ of formula (1) is an electron-withdrawing group;
3. The photothermographic imaging material described in 1. or 2, wherein $R_{11}$ in formula (1) and $X_{21}$ in formula (2) are a cyano group;
4. The photothermographic imaging material described in any of 1. through 3, wherein one of $R_{12}$ and $R_{13}$, or $R_{22}$ and $R_{23}$ is a hydrogen atom and the other one is an electron-donating group;
5. The photothermographic imaging material described in any of 1. through 4., wherein the aromatic polyisocyanate compound is represented by formula (Z):

$$(X_2{=}C{=}N{-}J_1)_{v2}{-}L{-}[J_1{-}(N{=}C{=}X_2)_{v1}]_n \qquad \text{formula (Z)}$$

wherein $J_1$ is a substituted or unsubstituted arylene group, or a substituted or unsubstituted heterocyclic group; L is a polyvalent linkage group derived from a substituted or unsubstituted alkyl, alkenyl, aryl or heterocyclic group, or a linkage group formed by linking these groups through a bond or a linking group; $X_2$ is an oxygen atom or a sulfur atom; v1 is an integer of 1 or more, v2 is 0 or an integer of 1 or more, and n is an integer of 1 or more, provided that when v2 is 0, v1 or n is an integer of 2 or more.

6. The photothermographic imaging material described in any of 1. through 5., wherein the light-insensitive aliphatic carboxylic acid silver salt is one which is formed in the presence of a compound capable of functioning as a crystal growth-retarding agent or a dispersing agent;
7. The photothermographic imaging material described in 6, wherein the crystal growth-retarding agent or a dispersing agent contains a hydroxy or carboxy group;
8. An image recording method, wherein the photothermographic material described in any of 1 through 7 is exposed by using a laser exposure apparatus, in which scanning laser light is not exposed at an angle substantially vertical to the exposed surface of the photosensitive material;
9. An image recording method, wherein the photothermographic material described in any of 1 through 7 is exposed by using a laser exposure apparatus, in which scanning laser light is longitudinally multiple.
10. An image recording method, wherein scanning exposure is performed onto the photothermographic material described in any of 1. through 7. using at least two laser beams to record images;
11. The image recording method described in any of 8 through 10, wherein the laser beams used in the scanning exposure are one of 600 to 1200 nm wavelength;
12. An image forming method, wherein the photothermographic material described in any of 1 through 7 is processed at a temperature of 100 to 150° C.;

In this invention, it was discovered that incorporation of at least one of the foregoing compounds represented by formulas (1) through (3) leads to a photothermographic material exhibiting enhanced sensitivity, higher maximum density (Dmax), superior storage stability and higher contrast. It was further discovered that the use of hydrazine derivatives represented by (H-1) or (H-2) in JP-A 2001-174945, in combination with the foregoing compounds led to further enhanced effects of the invention.

DETAILED DESCRIPTION OF THE INVENTION

One aspect of the invention is that the photothermographic material contains at least one compound selected from the compounds represented by formulas (1) to (3).

Next, the compounds represented by formulas (1) to (3) will be described.

First, the electron-donating group and electron-withdrawing group will be described. In the invention, the electron-donating group refers to one having a negative value of a Hammett substituent constant (σp). Examples the electron-donating group include hydroxy group (or its salt), an alkoxy group, an aryloxy group, heterocyclic-oxy group, an amino group, an alkylamino group, an arylamino group and a heterocyclic amino group, a heterocyclic group having a negative σp value, and a phenyl group substituted by the foregoing electron-donating groups.

The electron-withdrawing group refers to one having a positive value of a Hammett substituent constant (σp). Examples the electron-withdrawing group include a halogen atom, cyano group, nitro group, alkenyl group, alkynyl group, acyl group, alkoxycarbonyl group, aryloxycarbonyl group, alkylsulfonyl group, arylsulfonyl group, carbamoyl group, carbonamido group, sulfamoyl group, sulfonamido group, trifluoromethyl group, phospholyl group, carboxy group (or its salt), sulfo group (or its salt), imino group, heterocyclic group having a positive σp value, and a phenyl group substituted by the foregoing electron-withdrawing group.

The Hammett rule is an empirical rule proposed by L. P. Hammett in 1935 to quantitatively discuss effects of substituents on reactions or equilibriums of benzene derivatives and nowadays, validity of this empirical rule is recognized. The substituent constants determined in the Hammett rule include a σp value and a σm value, which are described commonly known literatures, including, for example, Lange's Handbook of Chemistry (by J. A. Dean), $12^{th}$ edition (1979, McGraw-Hill); "Kagaku-no-Ryoiki" vol. 122, page 96–103, (1979, NANKOHDO); Chemical Review vol. 91, page 165–195 (1991). The electron-withdrawing groups and electron-donating groups relating to the invention are defined by a σp value but are not limited to substituents having values described in the foregoing literatures.

Next, compounds represented by formula (1) will be described. In formula (1), $X_{11}$ is an electron-donating heterocyclic group, a cycloalkyloxy group, a cycloalkylthio group, a cycloalkylamino group or cycloalkenyl group. Electron-donating heterocycles are ones having a negative σp value, representative examples of which are described in "Substituent Constants for Correlation Analysis in Chemistry and Biology" (By Corwin Hansch and Albert Leo) page 66–339. Specific examples of the heterocyclic group include a piperidynyl group, pyrrolidynyl group, morpholine group, piperazinyl group, 3-thienyl group, 2-furyl group, 3-furyl group and 2-pyrrolo group of these, a 3-thienyl group, 2-furyl group and 3-furyl group are preferred. These heterocyclic groups may be substituted by an substituent within the range of σp being not 0 or positive. Examples of the cycloalkyloxy group, cycloalkylthio group, and cycloalkylamino group include cyclopropyloxy, cyclopentyloxy, cyclohexyloxy, cycloheptyloxy, cyclopropylthio, cyclopentylthio, cyclohexylthio, cycloheptylthio, cylopropylmethylamino, cyclopentylmethylamino, cyclohexylmethylamino, and cycloheptylmethylamino. Of these, cyclopentyloxy, cyclohexyloxy, cyclopentylthio and cyclohexylthio are preferred. Examples of the cycloalkenyl group include cyclopropenyl, cyclobutenyl, cyclopentenyl, cyclohexenyl and cycloheptenyl. Of these, cyclopentenyl and cyclohexenyl are preferred.

$R_{11}$, $R_{12}$ and $R_{13}$ are each a hydrogen atom or a univalent substituent. Examples of the univalent substituent include an alkyl group, an alkenyl group, an alkynyl group, an aryl group, a heterocyclic group, a heterocyclic group containing a quaternary nitrogen atom (e.g., pyridinium group), a hydroxy group, an alkoxy group (e.g., group containing ethyleneoxy or propyleneoxy group, as a repeating unit), an aryloxy, an acyloxy, an acyl group, an alkoxycarbonyl group, an aryloxycarbonyl group, a carbamoyl group, a urethane group, a carboxyl group, an imido group, an amino group, a carbonamido group, a sulfonamido group, a ureido group, a thioureido group, a sulfamoylamino group, a semicarbazido group, a thiosemicarbazido group, a hydrazine group, a quaternary ammonio group, (alkyl, aryl, or heterocycle)-thio group, mercapto group, (alkyl or aryl)-sulfonyl group, (alkyl or aryl)-sulfinyl group, a sulfo group, a sulfamoyl group, a acylsulfamoyl group, (alkyl or aryl)-sulfonylureido group, (alkyl or aryl)-sulfonylcarbamoyl group, a halogen atom, cyano group, nitro group, and a phosphoric acid amide group. $R_{11}$ is preferable an electron-withdrawing group, and more preferable cyano group. $R_{12}$ is preferably a hydrogen atom and $R_{13}$ is preferably an electron-donating group. It is more preferred that $R_{11}$ by cyano group, $R_{12}$ be a hydrogen atom, and $R_{13}$ be hydroxy group.

Specific examples of the compound represented by formula (1) are shown below, but the invention is by no means limited to these. In cases where keto-enol type tautomeric isomers or cis-trans type geometrical isomers exist in the compounds described below, both of them are included.

Exemplary Compound

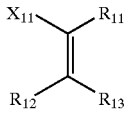

| | $X_{11}$ | $R_{11}$ | $R_{12}$ | $R_{13}$ |
|---|---|---|---|---|
| 1-1 | 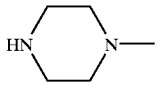 | —CN | —$OC_2H_5$ | —OH |
| 1-2 | 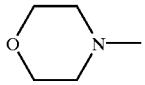 | —$NO_2$ | —$SCH_3$ | —OH |
| 1-3 | 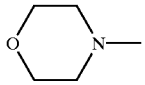 | —CN | —H | —OH |
| 1-4 | 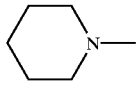 | —Cl | —H | —OH |
| 1-5 | 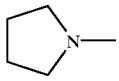 | —$CF_3$ | —H | —Cl |
| 1-6 | 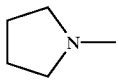 | —CN | —H | —OH |
| 1-7 | 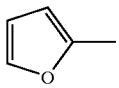 | —$SO_2CH_3$ | —$OC_2H_5$ | —Cl |
| 1-8 | 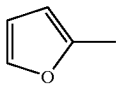 | —CN | —H | —OH |
| 1-9 | 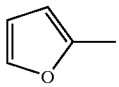 | —$COCF_3$ | —H | —OH |
| 1-10 | 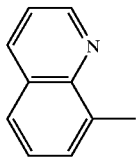 | —Cl | —$OC_2H_5$ | —OH |
| 1-11 | 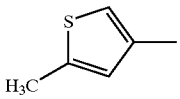 | —CN | —H | —OH |

-continued
Exemplary Compound
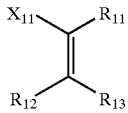
| | $X_{11}$ | $R_{11}$ | $R_{12}$ | $R_{13}$ |
|---|---|---|---|---|
| 1-12 | 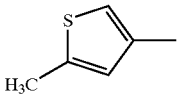 | —$COOC_2H_5$ | —H | —OK |
| 1-13 | 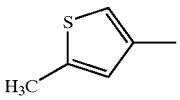 | —$SO_2Ph$ | —H | —OH |
| 1-14 | 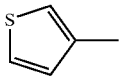 | —CN | —H | —OH |
| 1-15 | 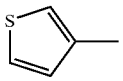 | —$COCH_3$ | —H | —OH |
| 1-16 | 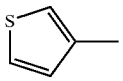 | —CN | —H | —ONa |
| 1-17 | 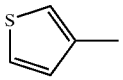 | 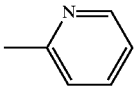 | —H | —Cl |
| 1-18 | 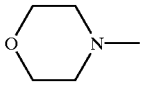 | —$SCH_3$ | —H | —$OC_2H_5$ |
| 1-19 | 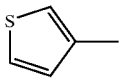 | —$OC_2H_5$ | —H | —OH |
| 1-20 | 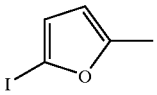 | 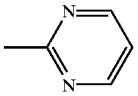 | —H | —$COCH_3$ |
| 1-21 | 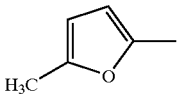 | —Cl | —$SCH_3$ | —OH |
| 1-22 | 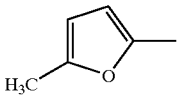 | —$COCH_3$ | —H | —OH |
| 1-23 | 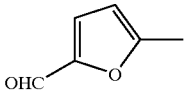 | —CN | —Cl | —OH |
| 1-24 | 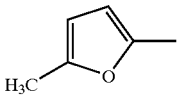 | —$CH_3$ | —H | —OH |

-continued
Exemplary Compound
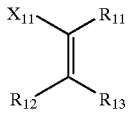
| | $X_{11}$ | $R_{11}$ | $R_{12}$ | $R_{13}$ |
|---|---|---|---|---|
| 1-25 | 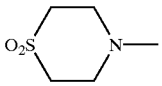 | —CN | —H | —OH |
| 1-26 | 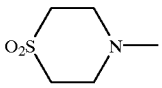 | —$COOC_2H_5$ | —H | —$OC_2H_5$ |
| 1-27 | 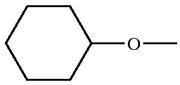 | —CN | —H | —OH |
| 1-28 | 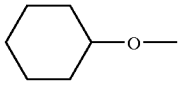 | —$SO_2Ph$ | —$COOC_2H_5$ | —H |
| 1-29 | 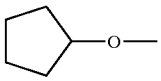 | —CN | —H | —OH |
| 1-30 | 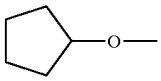 | —$COOC_2H_5$ | —Cl | —H |
| 1-31 | 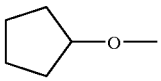 | 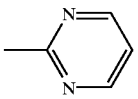 | —CN | —$OC_2H_5$ |
| 1-32 | 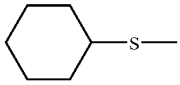 | —$COCF_3$ | —$SCH_3$ | —$SCH_3$ |
| 1-33 | 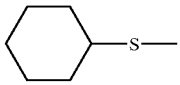 | —CN | —H | —OH |
| 1-34 | 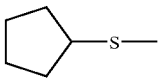 | —$COOC_2H_5$ | —$OC_2H_5$ | —H |
| 1-35 | 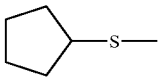 | —CN | —H | —OH |
| 1-36 | 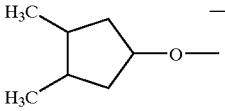 | —$COOC_2H_5$ | —$OC_2H_5$ | —H |
| 1-37 | 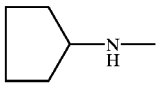 | —$COCF_3$ | —CN | —$OC_2H_5$ |

-continued
Exemplary Compound
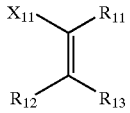
| | $X_{11}$ | $R_{11}$ | $R_{12}$ | $R_{13}$ |
|---|---|---|---|---|
| 1-38 | 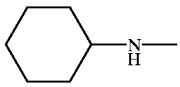 | $—COOC_2H_5$ | —H | —H |
| 1-39 | 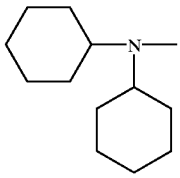 | 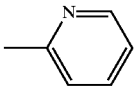 | $—OC_2H_5$ | —H |
| 1-40 | 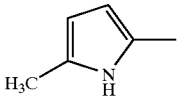 | —CN | —H | —OH |
| 1-41 | 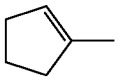 | $—COOC_2H_5$ | —H | $—OC_2H_5$ |
| 1-42 | 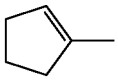 | —CN | —H | —OH |
| 1-43 | 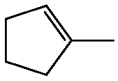 | $—SO_2Ph$ | $—COOC_2H_5$ | —H |
| 1-44 | 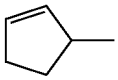 | —CN | —H | —OH |
| 1-45 | 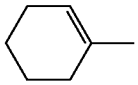 | $—COOC_2H_5$ | —Cl | —H |
| 1-46 | 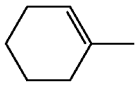 | —CN | —H | —OH |
| 1-47 | 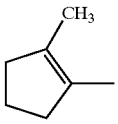 | $—COCF_3$ | $—SCH_3$ | $—SCH_3$ |
| 1-48 | 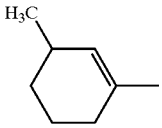 | —CN | —H | —OH |

-continued

| | Exemplary Compound | | | |
|---|---|---|---|---|
| | $X_{11}$ | $R_{11}$ | $R_{12}$ | $R_{13}$ |
| 1-49 | 1-49 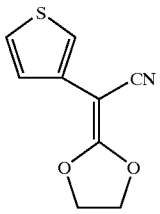 | | | |
| 1-50 | 1-50 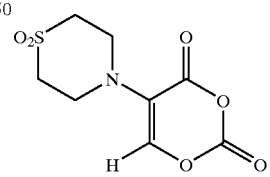 | | | |
| 1-51 | 1-51 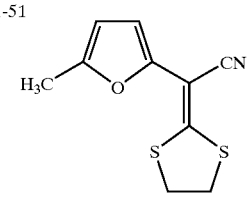 | | | |
| 1-52 | 1-52 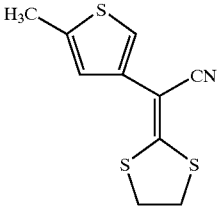 | | | |

Next, the compound represented by formula (2) will be described. In the formula (2), $R_{21}$ is an alkyl group, $R_{22}$ and $R_{23}$ are each a hydrogen atom or a univalent substituent, $X_{21}$ is an electron-withdrawing group, $L_{21}$ is an aromatic carbon ring group (or aromatic hydrocarbon group), and n2 is 0 or 1. Specific examples of the alkyl group represented by $R_{21}$ include methyl, ethyl, propyl, isopropyl, butyl, pentyl, hexyl, heptyl, and octyl. Of these, methyl, ethyl and propyl are preferred. Specific examples of the univalent substituent represented by $R_{22}$ and $R_{23}$ include the same as cited in $R_{11}$, $R_{12}$ and $R_{13}$ of formula (1). Specific examples of the electron-withdrawing group represented by $X_{21}$ include the same as cited in $R_{11}$ of formula (1). Specific examples of the aromatic carbon ring group represented by $L_{21}$ include phenylene and naphthylene groups, which may be substituted. It is more preferred that $R_{22}$ and $R_{23}$ be a hydrogen atom and an electron-donating group, respectively. It is still more preferred that $X_{21}$, $R_{22}$ and $R_{23}$ be cyano, hydrogen atom and hydroxy, respectively.

Specific examples of the compound represented by formula (2) are shown below, but the invention is by no means limited to these. In cases where keto-enol type tautomeric isomers or cis-trans type geometrical isomers exist in the compounds described below, both of them are included.

Exemplary Compound
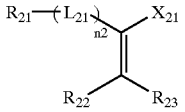
| | $R_{21}$ | $L_{21}$ | n2 | $R_{22}$ | $R_{23}$ | $X_{21}$ |
|---|---|---|---|---|---|---|
| 2-1 | $H_3C$— | — | 0 | —H | —OH | —CN |
| 2-2 | $H_3C$— | — | 0 | —Cl | —$OC_2H_5$ | —$COOC_2H_5$ |
| 2-3 | $C_2H_5$— | — | 0 | —H | —$SCH_3$ | —$COCH_3$ |
| 2-4 | $C_3H_7$— | — | 0 | —H | —OH | —CN |
| 2-5 | $C_5H_{11}$— | — | 0 | —H | —OH | —$SO_2Ph$ |
| 2-6 | $C_6H_{13}$— | — | 0 | —H | —$OC_2H_5$ | —CN |
| 2-7 | 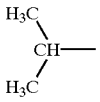 | — | 0 | —H | —OH | —CN |
| 2-8 | 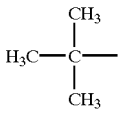 | — | 0 | —H | —OH | —$COCH_3$ |
| 2-9 | 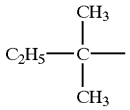 | — | 0 | —H | —OH | —$COOC_2H_5$ |
| 2-10 | $H_3C$— | 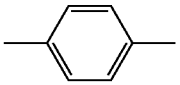 | 1 | —Cl | —OH | —$COCH_3$ |
| 2-11 | $H_3C$— | 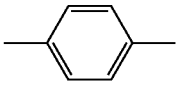 | 1 | —H | —OH | —CN |
| 2-12 | $H_3C$— | 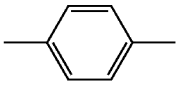 | 1 | —H | —$OC_2H_5$ | —CN |
| 2-13 | $H_3C$— | 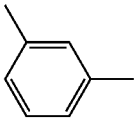 | 1 | —H | —OH | —CN |
| 2-14 | $H_3C$— | 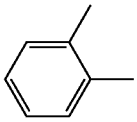 | 1 | —H | —OH | —CN |
| 2-15 | $H_3C$— | 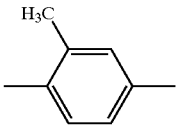 | 1 | —H | —OH | —$COCH_3$ |
| 2-16 | $C_2H_5$— | 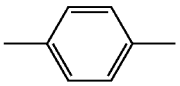 | 1 | —H | —OH | —CN |

-continued

Exemplary Compound

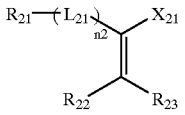

| | $R_{21}$ | $L_{21}$ | n2 | $R_{22}$ | $R_{23}$ | $X_{21}$ |
|---|---|---|---|---|---|---|
| 2-17 | $H_3C$— | 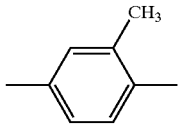 | 1 | —H | —OH | —CN |
| 2-18 | $H_3C$— | 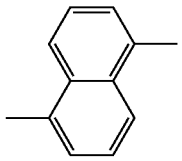 | 1 | —H | —$OC_2H_5$ | —$SO_2Ph$ |

Next, the compound represented by formula (3) will be described. In the formula (3), $X_{31}$ is an electron-withdrawing heterocyclic group, a halogen atom or a haloalkyl group; one of $R_{31}$ and $R_{32}$ is a hydrogen atom and the other one is a hydroxy group.

Electron-withdrawing heterocycles are ones having a positive σp value, and representative examples thereof are described in "Substituent Constants for Correlation Analysis in Chemistry and Biology" (By Corwin Hansch and Albert Leo) page 66–339 and exemplary examples thereof include 2-pyridyl, 2-pyrimidyl, 2-pyrazyl, 2-quinqzolyl, 2-benzothiazolyl and 2-benzooxazolyl. These heterocyclic groups may be substituted by an substituent within the range of σp being not 0 or negative. Preferred examples of the electron-withdrawing group include 2-pyridyl, 2-pyrimidyl, and 2-piperazyl. Examples of the halogen atom, fluorine atom, chlorine atom, bromine atom and iodine atom, and of these, chlorine and bromine atoms are preferred. Examples of the haloalkyl group include monochloromethyl, dichloromethyl, trichloromethyl, tribromomethyl, trifluoromethyl, 1,2-dichloroethyl, and pentafluoroethyl. Of these, trichloromethyl, tribromomethyl and trifluoromethyl are preferred.

Specific examples of the compound represented by formula (3) are shown below, but the invention is by no means limited to these. In cases where keto-enol type tautomeric isomers or cis-trans type geometrical isomers exist in the compounds described below, both of them are included.

Exemplary Compound 3-1

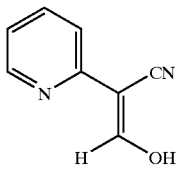

-continued

Exemplary Compound 3-2

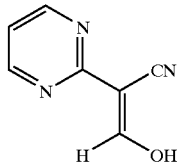

3-3

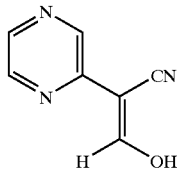

3-4

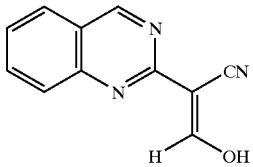

3-5

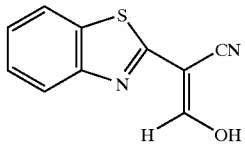

3-6

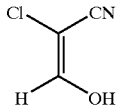

3-7

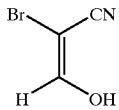

-continued

| Exemplary Compound | |
|---|---|
| 3-8 | 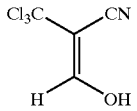 |
| 3-9 | 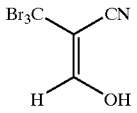 |
| 3-10 | 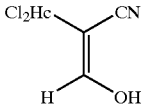 |

Crosslinking agents usable in the invention include various crosslinking agents used for photographic materials, such as aldehyde type, epoxy type, vinylsulfon type, sulfonester type, acryloyl type, carbodiimide type crosslinking agents, as described in JP-A 50-96216. Specifically preferred are an isocyanate type compound, epoxy compound and acid anhydride, as shown below.

The foregoing isocyanate type compound used as a crosslinking agent is an isocyanate compound containing at least two isocyanate group, i.e., polyisocuanate compound or its adduct. Examples thereof include aliphatic diisocyanates, alicyclic diisocyanates, benzene-diisocyanates, naphthalene-diisocyanates, biphenyldiisocyanates, diphenylmethandiisocyanates, triphenylmethanediisocyanates, triisocyanates, tetraisocyanates, their adducts and adducts of these isocyanates and polyhydric alcohols such as dios or triols. Exemplary examples are isocyanate compounds described in JP-A 56-5535 at pages 10–12. Specifically, adduct of isocyanate and polyhydric alcohol improves adhesion between layers, exhibiting high capability of preventing layer peeling, image slippage or production of bubbles.

Of the foregoing isocyanate compounds, aromatic polyisocyanate compounds are preferred as a cross-linking agent used in the invention. Specifically, of the aromatic polyisocyanate compounds, the use of the aromatic polyisocyanate compound represented by the formula (Z) described earlier in combination with the compound represented by formulas (1) through (3) described earlier was proved to result in an enhanced maximum density, improved fogging and superior storage stability.

In the formula (Z), v1 is an integer of 1 or more (preferably 1 to 6, and more preferably 1, 2 or 3), v2 is 0 or an integer of 1 or more, and n is an integer of 1 or more, provided that when v2 is 0, v1 or n is an integer of 2 or more; $J_1$ is a substituted or unsubstituted arylene or a substituted or unsubstituted heterocyclic group; L is a polyvalent (i.e., two- or more valent) linkage group derived from a substituted or unsubstituted alkyl, alkenyl, alkyl, aryl or heterocyclic group, or a linkage group formed by linking these groups through a bond or a linking group. $X_2$ is an oxygen atom or a sulfur atom; n is 0 or 1. Preferred examples of substituents include a halogen atom (e.g., chlorine, bromine, etc.), an alkyl group (e.g., methyl, ethyl, propyl, hexyl, cyclohexyl, etc.), an aryl group (e.g., phenyl naphthyl, tolyl, etc.), a heterocyclic group (e.g., furan ring, thiophene ring, etc.) and an alkoxy group (e.g., methoxy, ethoxy, etc.).

Examples of the polyvalent linkage group derived from an alkyl group, alkenyl group, alkynyl group, aryl group or heterocyclic group represented by L include an alkylene group (e.g., methylene, ethylene, propylene, butylenes, pentylene, etc.), an alkenylene group (e.g., ethenylene, propenylene, butadienylene, pentadienylene, etc.), an alkynylene group (e.g., ethynylene, butynylene, etc.) and an arylene group (e.g., phenylene, naphthylene, etc.). Of the polyvalent group derived from an aryl or heterocyclic group, examples of aryl ring include benzene, naphthalene, toluene and xylene rings; and examples of heterocyclic ring include furan, thiophene, isocyanule rings.

Further, the linkage groups derived from an alkyl group, alkenyl group or alkynyl group include a tri- or more valent group (poly-valent group), e.g.,

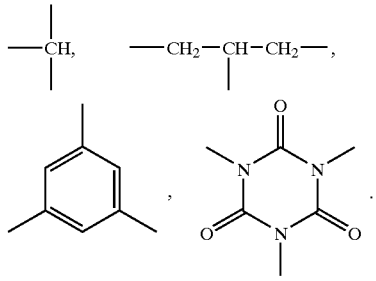

Furthermore, L may be a linkage group formed by linking these groups through a linking group. In this case, the linking groups include a bond or linking groups comprising oxygen (O), nitrogen (N), sulfur (S) or phosphorus (P), which may further contain a carbon atom, such as —O—, —S—, —NH—, —CO—, —SO—, —$SO_2$—, —NHCO—, —PO—, and —PS—.

Specific examples of the aromatic polyisocyanate compounds relating to the invention are shown below.

IH-1

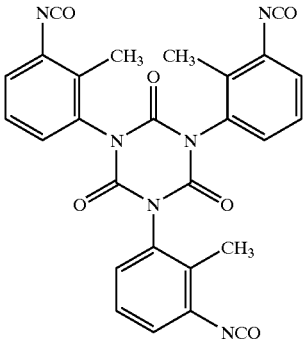

IH-2

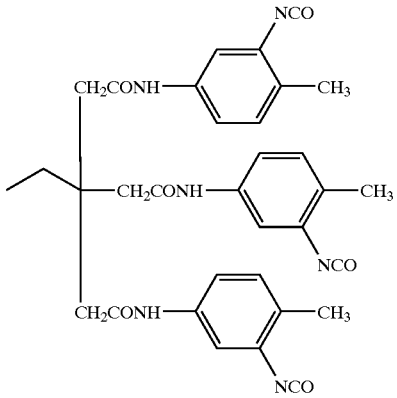

-continued
IH-3
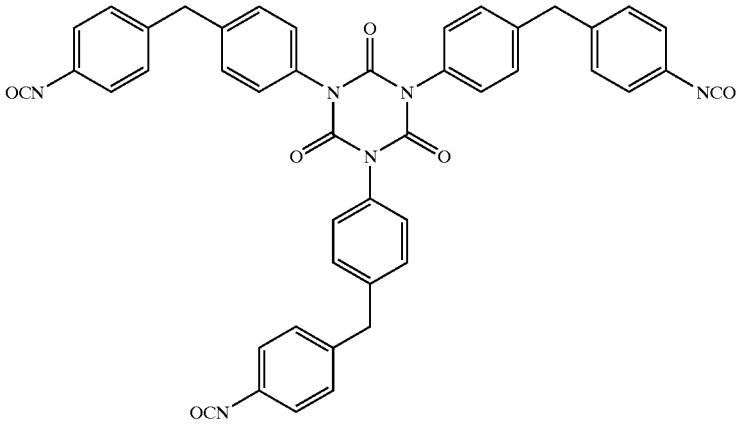
IH-4
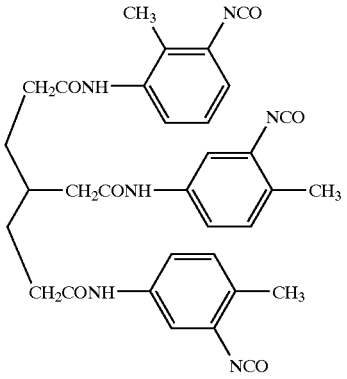
IH-5
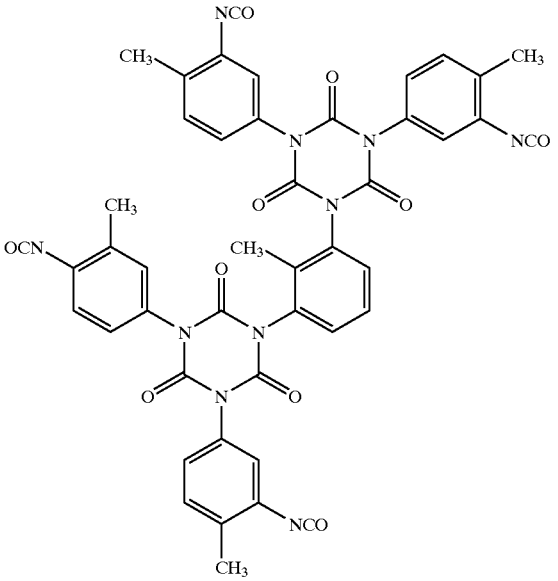
IH-6
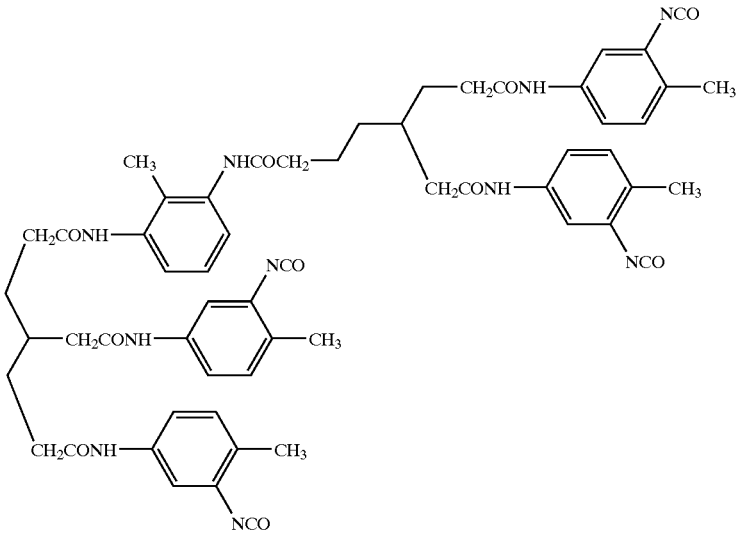

-continued
IH-7
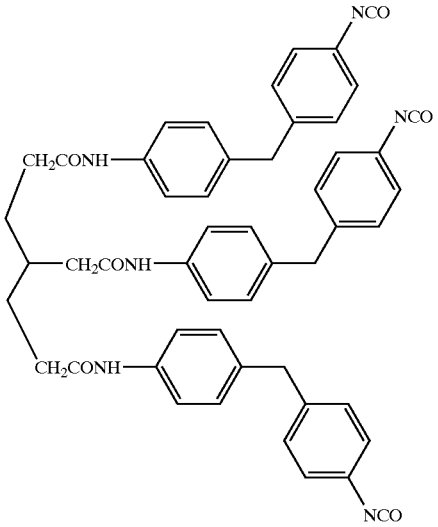
IH-8
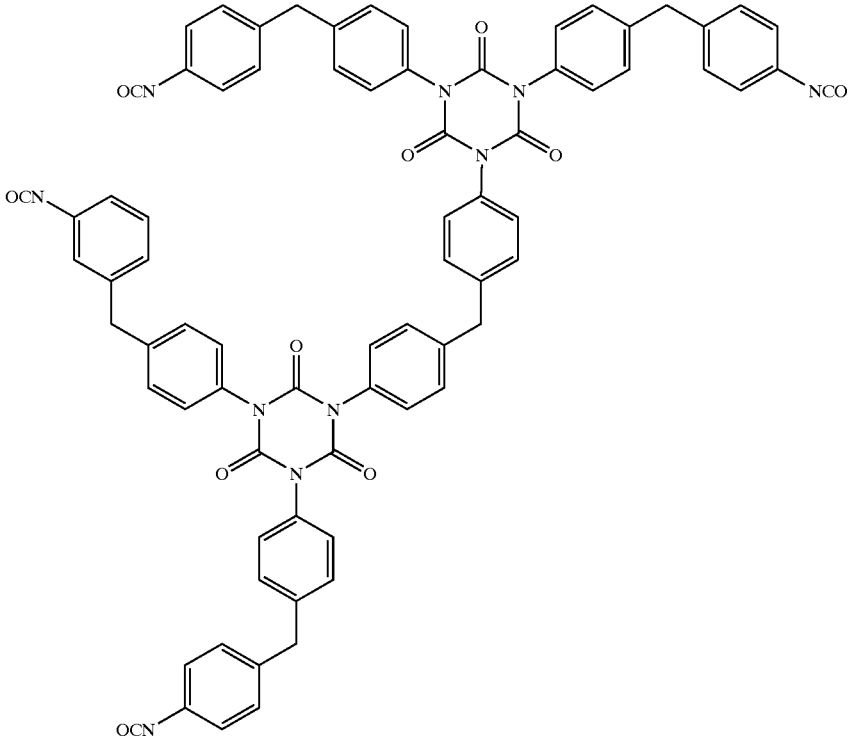
IH-9
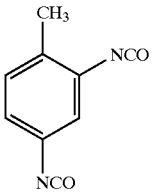
H-10
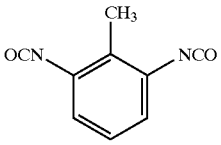
IH-11
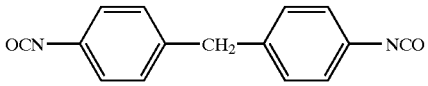
IH-12
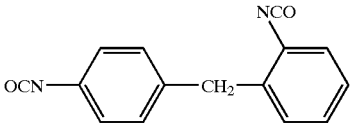

-continued

IH-13

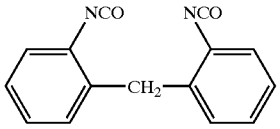

IH-14

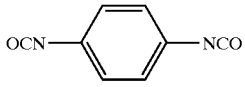

IH-15

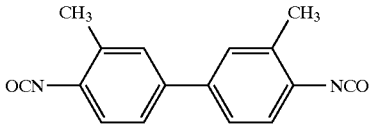

IH-16

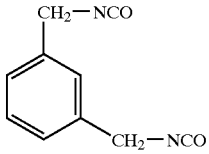

IH-17

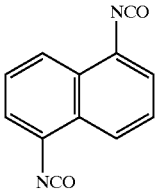

IH-18

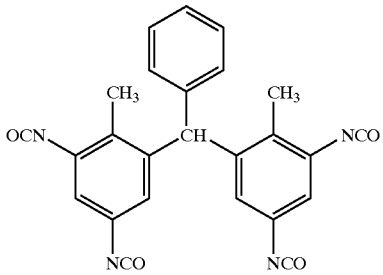

IH-19

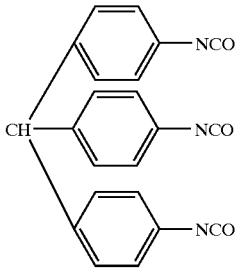

IH-20

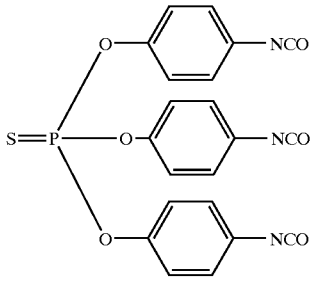

IH-21

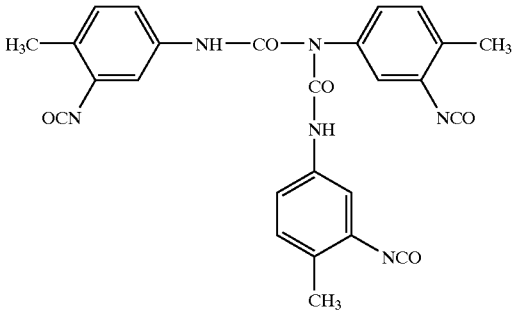

IH-22

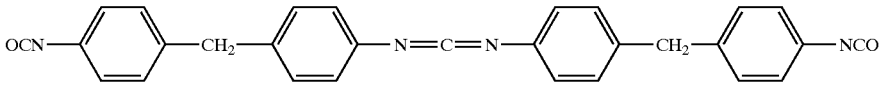

IH-23

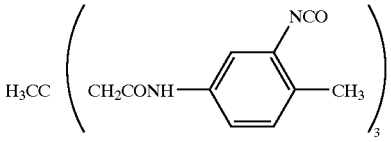

These isocyanate compounds may be incorporated into any portion of the photothermographic material, for example, into the interior of a support (e.g., into size of a paper support) or any layer on the photosensitive layer-side of the support, such as a photosensitive layer, surface protective layer, interlayer, antihalation layer or sublayer. Thus it may be incorporated into one or plurality of these layers.

The thioisocyanate type crosslinking agent usable in the invention is to be a compound having a thioisocyanate structure, corresponding to the isocyanates described above.

The crosslinking agents described above are used preferably in an amount of 0.001 to 2 mol, and more preferably 0.005 to 0.5 mol per mol of silver. The cross linking agents may be used in combination within the foregoing range. The isocyanate compounds and thioisocyanate compounds used in the invention preferably are those which are capable of functioning as a hardener.

Examples of silane compounds used as a crosslinking agent include the compounds represented by formulas (1) and (2) described in Japanese Patent Application No. 2000-77904.

The epoxy compound usable in the invention may be any one containing at least one epoxy group and is not limited with respect to the number of the epoxy group, molecular weight and other parameters. The epoxy group is preferably contained in the form of a glycidyl group through an ether bond or an imino bond in the molecule. The epoxy compound may be any one of a monomer, oligomer and polymer, in which the number of the epoxy group in the molecule is preferably 1 to 10 and more preferably 2 to 4. In cases where the epoxy compound is a polymer, it may be either one of a homopolymer and a copolymer. The number-averaged molecular-weight (Mn) thereof is preferably 2,000 to 20,000.

The epoxy compound used in the invention is preferably a compound represented by the following formula [B]:

Formula [B]

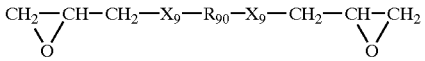

wherein $R_{90}$ is an alkylene group which may be substituted by a substituent selected from a halogen atom, a hydroxyalkyl group and an amino group. $R_{90}$ preferably contains an amide linkage, ether linkage or thioether linkage; a bivalent linkage group represented by $X_9$ is preferably —$SO_2$—, —$SO_2NH$—, —S—, —O— or —$NR_{91}$—, in which $R_{91}$ is a univalent linkage group and preferably an electron-withdrawing group.

The epoxy compounds may be used alone or combination thereof. The amount to be added is not specifically limited, but preferably $1\times10^{-6}$ to $1\times10^{-2}$ mol/m$^2$, and more preferably $1\times10^{-5}$ to $1\times10^{-3}$ mol/m$^2$. The epoxy compound may be added to any layer of a photosensitive layer, surface protective layer, interlayer, antihalation layer and subbing layer provided on the photosensitive layer-side of the support and may be added to one or plurality of these layers. Further, it may be added to a layer provided on the opposite side of the support, in combination with the photosensitive layer-side. In the case of a photothermographic material having photosensitive layers on both sides of the support, it may be added to any one of the layers.

The acid anhydride used in the invention is preferably a compound containing at least an acid anhydride group represented as below:

—CO—O—CO—

The acid anhydride usable in the invention may be any compound containing one or more acid anhydride group, the number of the acid anhydride group, molecular weight or other parameters are not specifically limited, and a compound represented by the following formula [C] is preferred:

Formula [C]

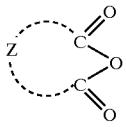

wherein Z is an atomic group necessary to form a monocyclic or polycyclic ring, which may be substituted. Examples of substituent include an alkyl group (e.g., methyl, ethyl, hexyl), an alkoxyl group (e.g., methoxy, ethoxy, octyloxy), an aryl group (e.g., phenyl, naphthyl, tolyl), hydroxy group, an aryloxy group (e.g., phenoxy), an alkylthio group (e.g., methylthio, butylthio), an arylthio group (e.g., phenylthio), an acyl group (e.g., acetyl, propionyl, butylyl), a sulfonyl group (e.g., methylsulfonyl, phenylsulfonyl), an acylamino group, a sulfonylamino group, an acyloxy group (e.g., acetoxy, benzoxy), carboxy group, cyano group, sulfo group and an amino group. It is preferred not to contain a halogen atom as a substituent.

The acid anhydride compound may be used alone or combination thereof. The amount to be added is not specifically limited, but preferably $1\times10^{-6}$ to $1\times10^{-3}$ mol/m$^2$, and more preferably $1\times10^{-4}$ to $1\times10^{-2}$ mol/m$^2$. The acid anhydride compound may be added to any layer of a photosensitive layer, surface protective layer, interlayer, antihalation layer and subbing layer provided on the photosensitive layer-side of the support and may be added to one or plurality of these layers. Further, it may be added to a layer containing the foregoing epoxy compound.

Next, there will be described light-sensitive silver halide grains (hereinafter, also denoted simply as silver halide grains) used in the photothermographic material relating to the invention.

The light sensitive silver halide grains used in the invention refers to silver halide crystal grains which have been treated and prepared so as to be capable of absorbing visible or infrared light and causing physico-chemical changes in the interior of and/or on the surface of the silver halide crystal when absorbing the visible or infrared light, essentially as a inherent property of a silver halide crystal or artificially by the physico-chemical method.

The silver halide grains used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof. Specifically, preparation of silver halide grains with controlling the grain formation condition, so-called controlled double-jet precipitation is preferred. The halide composition of silver halide is not specifically limited and may be any one of silver chloride, silver chlorobromide, silver iodochlorobromide, silver bromide, silver iodobromide and silver iodide.

The grain forming process is usually classified into two stages of formation of silver halide seed crystal grains (nucleation) and grain growth. These stages may continuously be conducted, or the nucleation (seed grain formation) and grain growth may be separately performed. The controlled double-jet precipitation, in which grain formation is undergone with controlling grain forming conditions such as pAg and pH, is preferred to control the grain form or grain size. In cases when nucleation and grain growth are separately conducted, for example, a soluble silver salt and a soluble halide salt are homogeneously and promptly mixed in an aqueous gelatin solution to form nucleus grains (seed grains), thereafter, grain growth is performed by supplying soluble silver and halide salts, while being controlled at a pAg and pH to prepare silver halide grains. After completing the grain formation, the resulting silver halide grain emulsion is subjected to desalting to remove soluble salts by commonly known washing methods such as a noodle washing method, a flocculation method, a ultrafiltration method, or electrodialysis to obtain desired emulsion grains.

In order to minimize cloudiness after image formation and to obtain excellent image quality, the less the average grain size, the more preferred, and the average grain size is preferably not more than 0.2 $\mu$m, more preferably between 0.01 and 0.17 $\mu$m, and still more preferably between 0.02 and 0.14 $\mu$m. The average grain size as described herein is defined as an average edge length of silver halide grains, in cases where they are so-called regular crystals in the form of cube or octahedron. Furthermore, in cases where grains are tabular grains, the grain size refers to the diameter of a circle having the same area as the projected area of the major faces. Furthermore, silver halide grains are preferably monodisperse grains. The monodisperse grains as described herein refer to grains having a coefficient of variation of grain size obtained by the formula described below:

Coefficient of variation of grain size=(standard deviation of grain diameter/average grain diameter)×100(%)

which is not more than 7%, more preferably not more than 5%, still more preferably not more than 3%, and optimally not more than 1%.

The grain form can be of almost any one, including cubic, octahedral or tetradecahedral grains, tabular grains, spherical grains, bar-like grains, and potato-shaped grains. Of these, cubic grains, octahedral grains, tetradecahedral grains and tabular grains are specifically preferred.

The aspect ratio of tabular grains is preferably 1.5 to 100, and more preferably 2 to 50. These grains are described in U.S. Pat. Nos. 5,264,337, 5,314,798 and 5,320,958 and desired tabular grains can be readily obtained. Silver halide grains having rounded corners are also preferably employed.

Crystal habit of the outer face (or surface) of the silver halide grains is not specifically limited, but in cases when using a spectral sensitizing dye exhibiting crystal habit (face) selectivity in the adsorption reaction of the sensitizing dye onto the silver halide grain surface, it is preferred to use silver halide grains having a relatively high proportion of the crystal habit meeting the selectivity. In cases when using a sensitizing dye selectively adsorbing onto the crystal face of a Miller index of [100], for example, a high ratio accounted for by a Miller index [100] face is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

It is preferred to use low molecular gelatin having an average molecular weight of not more than 50,000 in the preparation of silver halide grains used in the invention, specifically, in the stage of nucleation. Thus, the low molecular gelatin has an average molecular eight of not more than 50,000, preferably 2,000 to 40,000, and more preferably 5,000 to 25,000. The average molecular weight can be determined by means of gel permeation chromatography. Subjecting an aqueous gelatin conventionally used and having an average molecular weight of ca. 100,000 to enzymatic hydrolysis, acid or alkali hydrolysis, thermal degradation at atmospheric pressure or under high pressure, or ultrasonic degradation can obtain the low molecular weight gelatin.

The concentration of dispersion medium used in the nucleation stage is preferably not more than 5% by weight, and more preferably 0.05 to 3.0% by weight.

In the preparation of silver halide grains, it is preferred to use a compound represent by the following formula (D), specifically in the nucleation stage:

$$YO(CH_2CH_2O)m(C(CH_3)CH_2O)p(CH_2CH_2O)nY \qquad \text{formula (D)}$$

where Y is a hydrogen atom, —$SO_3M$ or —CO—B—COOM, in which M is a hydrogen atom, alkali metal atom, ammonium group or ammonium group substituted by an alkyl group having carbon atoms of not more than 5, and B is a chained or cyclic group forming an organic dibasic acid; m and n each are 0 to 50; and p is 1 to 100. Polyethylene oxide compounds represented by foregoing formula have been employed as a defoaming agent to inhibit marked foaming occurred when stirring or moving emulsion raw materials, specifically in the stage of preparing an aqueous gelatin solution, adding a water-soluble silver and halide salts to the aqueous gelatin solution or coating an emulsion on a support during the process of preparing silver halide photographic light sensitive materials. A technique of using these compounds as a defoaming agent is described in JP-A No. 44-9497. The polyethylene oxide compound represented by the foregoing formula also functions as a defoaming agent during nucleation. The compound represented by the foregoing formula (D) is used preferably in an amount of not more than 1%, and more preferably 0.01 to 0.1% by weight, based on silver.

The compound is to be present at the stage of nucleation, and may be added to a dispersing medium prior to or during nucleation. Alternatively, the compound may be added to an aqueous silver salt solution or halide solution used for nucleation. It is preferred to add it to a halide solution or both silver salt and halide solutions in an amount of 0.01 to 2.0% by weight. It is also preferred to make the compound represented by formula [5] present over a period of at least 50% (more preferably, at least 70%) of the nucleation stage.

The temperature during the stage of nucleation is preferably 5 to 60° C., and more preferably 15 to 50° C. Even when nucleation is conducted at a constant temperature, in a temperature-increasing pattern (e.g., in such a manner that nucleation starts at 25° C. and the temperature is gradually increased to reach 40° C. at the time of completion of nucleation) or its reverse pattern, it is preferred to control the temperature within the range described above.

Silver salt and halide salt solutions used for nucleation are preferably in a concentration of not more than 3.5N, and more preferably 0.01 to 2.5N. The flow rate of aqueous silver salt solution is preferably $1.5\times10^{-3}$ to $3.0\times10^{-1}$ mol/min per lit. of the solution, and more preferably $3.0\times10^{-3}$ to $8.0\times10^{-2}$ mol/min. per lit. of the solution. The pH during nucleation is within a range of 1.7 to 10, and since the pH at the alkaline side broadens the grain size distribution, the pH is preferably 2 to 6. The pBr during nucleation is 0.05 to 3.0, preferably 1.0 to 2.5, and more preferably 1.5 to 2.0.

Silver halide may be incorporated into an image forming layer by any means, in which silver halide is arranged so as to be as close to reducible silver source as possible. It is general that silver halide, which has been prepared in advance, added to a solution used for preparing an aliphatic carboxylic acid silver salt. In this case, preparation of silver halide and that of an aliphatic carboxylic acid silver salt are separately performed, making it easier to control the preparation thereof. Alternatively, as described in British Patent 1,447,454, silver halide and an aliphatic carboxylic acid silver salt can be simultaneously formed by allowing a halide component to be present together with an aliphatic carboxylic acid silver salt-forming component and by introducing silver ions thereto.

Silver halide can also be prepared by reacting a halogen containing compound with an aliphatic carboxylic acid silver salt through conversion of the aliphatic carboxylic acid silver salt. Thus, a silver halide-forming component is allowed to act onto a pre-formed aliphatic carboxylic acid silver salt solution or dispersion or a sheet material containing an aliphatic carboxylic acid silver salt to convert a part of the aliphatic carboxylic acid silver salt to photosensitive silver halide.

The silver halide-forming components include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof include inorganic halide compound such as a metal halide and ammonium halide; onium halides, such as trimethylphenylammonium bromide, cetylethyldimethylammonium bromide, and trimethylbenzylammonium bromide; halogenated hydrocarbons, such as iodoform, bromoform, carbon tetrachloride and 2-brom-2-methylpropane; N-halogenated compounds, such as N-bromosucciimde, N-bromophthalimide, and N-bromoacetoamide; and other halogen containing compounds, such as triphenylmethyl chloride, triphenylmethyl bromide, 2-bromoacetic acid, 2-bromoethanol and dichlorobenzophenone. As described above, silver halide can be formed by converting a part or all of an aliphatic carboxylic acid silver salt to silver halide through reaction of the aliphatic carboxylic acid silver salt and a halide ion. The silver halide separately prepared may be used in combination with silver halide prepared by conversion of at least apart of an aliphatic carboxylic acid silver salt. The silver halide which is separately prepared or prepared through conversion of an aliphatic carboxylic acid silver salt is used preferably in an amount of 0.001 to 0.7 mol, and more preferably 0.03 to 0.5 mol per mol of aliphatic carboxylic acid silver salt.

Silver halide used in the invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanate, thiocyanato, selenocyanato, tellurocyanato, azido and aqua, nitrosyl, thionitrosyl, etc., of which aqua, nitrosyl and thionitrosyl are preferred. When the aqua ligand is present, one or two ligands are preferably coordinated. L may be the same or different.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (e.g., alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

The aliphatic carboxylic acid silver salt (hereinafter, also denoted as aliphatic acid silver salt or silver aliphatic-carboxylate) used in the invention are reducible silver source, and silver salts of aliphatic carboxylic acids (also called simply as aliphatic acids or fatty acids) are preferred and silver salts of long chain fatty acid (preferably having 10 to 30 carbon atom and more preferably 15 to 25 carbon atoms) are more preferred. Exemplary preferred silver salts are salts of gallic acid, oxalic acid, behenic acid, arachidic acid and stearic acid. In the invention, the combined use of two or more aliphatic acid silver salts is preferred, enhancing developability and forming silver images with higher density and increased contrast. Such silver salts can be prepared by mixing a mixture of at least two aliphatic carboxylic acids with a silver ion solution.

The aliphatic carboxylic acid silver salt compound can be obtained by mixing an aqueous-soluble silver compound with a compound capable of forming a complex. Normal precipitation, reverse precipitation, double jet precipitation and controlled double jet precipitation, as described in JP-A 9-127643 are preferably employed. For example, to an organic acid can be added an alkali metal hydroxide (e.g., sodium hydroxide, potassium hydroxide, etc.) to form an alkali metal salt soap of the organic acid (e.g., sodium behenate, sodium arachidate, etc.), thereafter, the soap and silver nitrate are mixed by the controlled double jet method to form aliphatic carboxylic acid silver salt crystals. In this case, silver halide grains may be concurrently present.

The aliphatic carboxylic acid silver salt is preferably comprised of grains having an average circular equivalent diameter of 0.05 to 0.8 μm (and more preferably 0.2 to 0.5 μm) and an average thickness of 0.005 to 0.07 μm (and more preferably 0.01 to 0.05 μm). The average circular diameter of less than 0.05 results in deteriorated image lasting quality though transparency is superior; the average circular diameter of more than 0.8 μm led to marked haze. In cases where the average thickness was less than 0.005 μm, the increased grain surface area results in abruptly supplying silver ions, a lot of which remain in the layer in low density areas without being used to form silver images, leading to deterioration in image lasting quality. The average thickness of more than 0.07 μm decreases the grain surface area though enhanced image lasting quality, retarding the silver ion supply and resulting in non-uniform developed silver, specifically in high density areas, lading to reduction in maximum density.

The grain diameter was determined in the following manner. An aliphatic carboxylic acid silver salt dispersion was diluted, dispersed on the grid provided with a carbon support membrane, and then photographed at a direct magnification of 5,000 times using a transmission type electron microscope (TEM, 2000 FX type, available from Nihon Denshi Co., Ltd.). The thus obtained negative electron micrographic images were read as a digital image by a scanner to determine the diameter (circular equivalent diameter) using appropriate software. At least 300 grains were so measured to determine an average diameter.

The grain thickness is determined using a transmission type electron microscope in the following manner. First, a light sensitive layer, coated onto a support, is pasted onto a suitable holder employing an adhesive and is cut perpendicular to the support surface employing a diamond knife to prepare an ultra-thin slice, at a thickness of 0.1 to 0.2 μm. The thus prepared ultra-thin slice is supported on a copper mesh, and is placed onto a carbon membrane, which has been made to be hydrophilic by means of a glow discharge. Then, while cooling the resulting slice to not more than −130° C., the image in a bright visual field is observed at a magnification of 5,000 to 40,000 employing a transmission electron microscope (hereinafter referred to as TEM), and then images are quickly recorded employing an image plate, a CCD camera, etc. In such a case, it is recommended to suitably select a portion of said slice, which has neither been torn nor distorted in the visual field for observation.

The carbon membrane, which is supported by an organic film such as an extremely thin collodion, Formvar, etc., is preferably employed, and a film composed of only carbon, which is obtained by forming the film on a rock salt substrate and then dissolving away the substrate or by removing the foregoing organic film, employing an organic solvent or ion etching, is more preferably employed. The acceleration voltage of said TEM is preferably 80 to 400 kV, and is most preferably 80 to 200 kV.

Details of other means such as electron microscopic technology and sample preparation techniques can be referred to in "Igaku-Seibutsugaku Denshikenbikyo Kansatsuho (Medical and Biological Electron Microscopy", edited by Nippon Denshikenbikyo Gakkai, Kanto-Shibu, (Maruzen), and "Denshikenbikyo Seibutsu Shiryo Sakuseiho (Preparation Method of Biological Samples for Electron Microscopy)", edited by Nippon Denshikenbikyo Gakkai, Kanto-Shibu, (Maruzen).

The TEM image, recorded in an appropriate medium, is decomposed to at least 1024×1024 pixels or preferably at least 2048×2048 pixels, and is then subjected to image processing employing a computer. In order to carry out image processing, an analogue image recorded on a film strip is converted into a digital image employing a scanner etc., and the resulting image is preferably subjected to shading correction, contrast-edge enhancement, etc., based on specific requirements. Thereafter, a histogram is prepared and the portions corresponding to organic silver are extracted employing binary processing. At least 300 grains of the aliphatic carboxylic acid silver salt were manually measured with respect to the thus extracted thickness employing appropriate software.

Methods to prepare aliphatic carboxylic acid silver salt grains having the above-mentioned shape are not particularly restricted. The optimization of various conditions such as maintaining the mixing state during the formation of an organic acid alkali metal salt soap and/or the mixing state during the addition of silver nitrate to said soap. After tabular aliphatic carboxylic acid silver salt grains employed in the present invention are preliminarily dispersed together with binders, surface active agents, etc., if desired, the resulting mixture is preferably dispersed and pulverized by a media homogenizer, a high pressure homogenizer, or the like. During said preliminary dispersion, ordinary stirrers such as an anchor type, a propeller type, etc., a high speed rotation centrifugal radial type stirrer (Dissolver), as a high speed shearing stirrer (homomixer) may be employed.

Furthermore, employed as said media homogenizers may be rolling mills such as a ball mill, a satellite ball mill, a vibrating ball mill, medium agitation mills such as a bead mill, atriter, and others such as a basket mill. Employed as high pressure homogenizers may be various types such as a type in which collision occurs against a wall or a plug, a type in which liquid is divided into a plurality of portions and said portions are subjected to collision with each other, a type in which liquid is forced to pass through a narrow orifice, etc. Examples of ceramics employed as the ceramic beads include $Al_2O_3$, $BaTiO_3$, $SrTiO_3$, MgO, ZrO, BeO, $Cr_2O_3$, $SiO_3$, $SiO_2$—$Al_2O_3$, $Cr_2O_3$—MgO, MgO—CaO, MoO—C, MgO—$Al_2O_3$ (spinel), SiC, $TiO_2$, $K_2O$, $Na_2O$, BaO, PbO, $B_2O_3$, $BeAl_2O_4$, $Y_3Al_5O_{12}$, $ZrO_2$—$Y_2O_3$ (cubic zirconia), 3BeO—$Al_2O_3$-6$SiO_2$ (artificial emerald), C (artificial diamond), $SiO_2$-n$H_2O$, silicone nitride, yttrium-stabilized-zirconia, zirconia-reinforced-alumina. Yttrium-stabilized-zirconia and zirconia-reinforced-alumina are preferably employed in view that little impurity is generated by friction among the beads or the classifier during classifying them. The ceramics containing zirconia are called zirconia as an abbreviation.

In devices employed for dispersing the tabular aliphatic carboxylic acid silver salt grains employed in the present invention, preferably employed as the members which are in contact with the aliphatic carboxylic acid silver salt grains are ceramics such as zirconia, alumina, silicone nitride, boron nitride, or diamond. Of these, zirconia is the one most preferably employed.

While carrying out of the above-mentioned dispersion, the binder is preferably added so as to achieve a concentration of 0.1 to 10 wt % with reference to the weight of the aliphatic carboxylic acid silver salt, and the temperature is preferably maintained at no less than 45° C. from the preliminary dispersion to the main dispersion process. An example of the preferable operation conditions of a homogenizer, when employing high-pressure homogenizer as the dispersing machine, is twice or more operations at 300 to 1,000 kgf/cm$^2$. In the case when a media-dispersing machine is employed, a circumferential speed of 6 to 13 m/sec. is preferable.

The compound capable of functioning as a crystal growth retarding agent or dispersing agent for aliphatic carboxylic acid silver salt grains refers to one which has a function or effect of forming grains with reduced size and enhanced uniformity thereof when prepared in the presence of the compound, as compared to the absence thereof. Specific examples of such compounds include monohydric alcohols having 10 or less carbon atoms (preferably secondary and tertiary alcohols), glycols such as ethylene glycol and propylene glycol, poly-ethers such as polyethylene glycol, and glycerin. Such compounds are added in an amount of 10 to 200% by weight, based on aliphatic carboxylic acid silver salt.

Branched aliphatic carboxylic acids including isomers thereof are also preferable, such as isohetanoic acid, isodecanoic acid, isotridecanoic acid, isomyristic acid, isopalmitic acid, isostearic acid, isoarachidic acid, isobehenic acid and isohexanoic acid. In this case, a preferable branched chain is an alkyl or alkenyl group having 4 or less carbon atoms. Further, unsaturated aliphatic carboxylic acids are cited, such as palmothreic acid, oleic acid, linolic acid, linileic acid, moroctic acid, eicosenic acid, aracj¥hidonic acid, eicopentaenic acid, erucic acid, docosapentaenic acid, and selacholeic acid. These compounds are added in an amount of 0.5 to 10 mol %, based on aliphatic carboxylic acid silver salt.

Preferred compounds include glycosides such as gluciside, galactoside and fructoside; trehalose type disaccharides such as trahalose and sucrose; polysaccharides such as glycogen, dextrin, dextran and alginic acidcellosolves such as methyl cellosolve and ethyl cellosolve; water-soluble organic solvents such as sorbitan, sorbitol, ethyl acetate, methyl acetate, and dimethyl formamide; water-soluble polymers such as polyvinyl alcohol, polyacrylic acid, acrylic acid copolymer, maleic acid copolymer, carboxymethyl cellulose, hydroxypropyl cellulose, hydroxypropylmethyl cellulose, polyvinyl pyrrolidone and gelatin. These compounds are added preferably in an amount of 0.1 to 20% by weight.

Alcohols having 10 or less carbon atoms are preferred, and the use of secondary or tertiary alcohols enhances solubility of sodium salt of an aliphatic carboxylic acid, resulting in reduced viscosity and enhancing stirring efficiency, leading to formation of monodisperse fine grains. Branched aliphatic carboxylic acids and unsaturated carboxylic acids exhibit higher steric hindrance than straight chain aliphatic carboxylic acids, resulting in fine crystals due to increased disorder in crystal lattice.

With regard to the difference in constitution between a conventional silver salt photographic material and a photothermographic imaging material, the photothermographic imaging material contains relatively large amounts of light sensitive silver halide, a carboxylic acid silver salt and a reducing agent which often cause fogging and silver printing-out (print out silver). In the photothermographic imaging material, therefore, an enhanced technique for antifogging and image-lasting is needed to maintain storage stability not only before development but also after development. In addition to commonly known aromatic heterocyclic compounds to restrain growth of fog specks and development thereof, there were used mercury compounds having a function of allowing the fog specks to oxidatively die away. However, such a mercury compound causes problems with respect to working safety and environment protection. Next, antifoggants and image stabilizers used in the photothermographic imaging material used in the invention will be described.

As a reducing agent used in photothermographic materials are employed reducing agents containing a proton, such as bisphenols. Accordingly, a compound generating a labile species which is capable of abstracting a proton to deactivate the reducing agent is preferred. More preferred is a compound as a non-colored photooxidizing substance, which is capable of generating a free radical as a labile species on exposure. Any compound having such a function is applicable. However, a halogen radical, which easily forms silver halide is not preferred. An organic free radical composed of plural atoms is preferred. Any compound having such a function and exhibiting no adverse effect on the photothermographic material is usable irrespective of its structure. Of such free radical generation compounds, a compound containing an aromatic, and carbocyclic or heterocyclic group is preferred, which provides stability to the generated free radical so as to be in contact with the reducing agent for a period sufficient to react with the reducing agent to deactivate it. Representative examples of such compounds include biimidazolyl compounds and iodonium compounds.

Of such imidazolyl compounds, a compound represented by the following formula [1] is preferred:

formula [1]

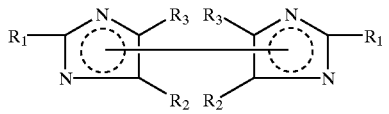

wherein $R_1$, $R_2$ and $R_3$ (,which may be the same or different) each are an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a hydrogen atom, a halogen atom, an aryloxyl (e.g., phenoxy), an alkylthio group (e.g., methylthio, butylthio), an arylthio group (e.g., phenylthio), a heterocyclic group (e.g., pyridyl, triazyl), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, a heterocyclic group, an alkenyl group and cyano group.

The biimidazolyl compounds can be synthesized in accordance with the methods described in U.S. Pat. No. 3,734,733 and British Patent 1,271,177. Preferred Examples thereof are described, for example, in JP-A No. 2000-321711.

Similarly preferred compounds include a iodonium compound represented by the following formula (2):

formula [2]

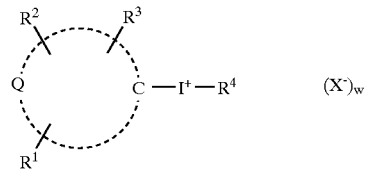

wherein Q is a group of atoms necessary to complete a 5-, 6-, or 7-membered ring, and the atoms being selected from a carbon atom, nitrogen atom, oxygen atom and sulfur atom; and $R^1$, $R^2$ and $R^3$ (,which may be the same or different) are each a hydrogen atom, an alkyl group (e.g., methyl, ethyl, hexyl), an alkenyl group (e.g., vinyl, allyl), an alkoxyl group (e.g., methoxy, ethoxy, octyloxy), an aryl group (e.g., phenyl, naphthyl, tolyl), hydroxy, a halogen atom, an aryloxyl (e.g., phenoxy), an alkylthio group (e.g., methylthio, butylthio), an arylthio group (e.g., phenylthio), an acyl group (e.g., acetyl, propionyl, butylyl, valeryl), a sulfonyl group (e.g., methylsulfonyl, phenylsulfonyl), an acylamino group, sulfonylamino group, an acyloxy group (e.g., acetoxy, benzoxy), carboxy, cyano, a sulfo group, or an amino group. Of these groups are preferred an aryl group, an alkenyl group and cyano group; $R^4$ is a carboxylate group such as acetate, benzoate or trifluoroacetate, or $O^-$; W is 0 or 1, provided that when $R^3$ is a sulfo group or a carboxy group, W is 0 and $R^4$ is $O^-$; $X^-$ is an anionic counter ion, including $CH_3CO_2$—, $CH_3SO_3$— and $PF_6^-$. When $R_3$ is a sulfo or carboxy group, W is 0 and $R_4$ is $O^-$. $R_1$, $R_2$ and $R_3$ may be linked together to form a ring.

Of these is specifically preferred a compound represented by the following formula [3]:

formula [3]

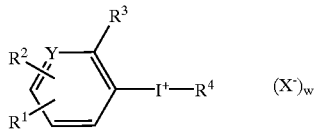

wherein $R^1$, $R^2$, $R^3$, $R^4$, $X^-$ and W are each the same as defined in formula [2]; Y is a carbon (i.e., —CH═) to form a benzene ring or a nitrogen atom (—N═) to form a pyridine ring.

The iodonium compounds described above can be synthesized in accordance with the methods described in Org. Syn., 1961 and Fieser, "Advanced Organic Chemistry" (Reinhold, N.Y., 1961). Examples of preferred compounds thereof are described in JP-A No. 2000-32 The compound releasing a labile species other than a halogen atom, such as represented by formula [1] or [2] is incorporated preferably in an amount of $10^{-3}$ to $10^{-1}$ mol/m$^2$, and more preferably $5\times10^{-3}$ to $5\times10^{-2}$ mol/m$^2$. The compound may be incorporated into any component layer of the photothermographic material relating to the invention and is preferably incorporated in the vicinity of a reducing agent.

As a compound capable of deactivating a reducing agent to inhibit reduction of an aliphatic carboxylic acid silver salt to silver by the reducing agent are preferred compounds releasing a labile species other than a halogen atom. However, these compounds may be used in combination with a compound capable of releasing a halogen atom as a labile species.

Examples of the compound releasing an active halogen atom include a compound represented by the following formula [4]:

formula [4]

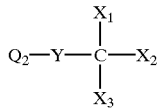

wherein $Q_2$ is an aryl group or a heterocyclic group; $X_1$, $X_2$ and $X_3$ are each a hydrogen atom, a halogen atom, a haloalkyl group, an acyl group, an alkoxycarbonyl group, an aryloxycarbonyl group, a sulfonyl group, an aryl group or a heterocyclic group, provided that at least of them a halogen atom; Y is —C(═O)—, —SO— or —$SO_2$—. The aryl group represented by $Q_2$ may be a monocyclic group or condensed ring group and is preferably a monocyclic or di-cyclic aryl group having 6 to 30 carbon atoms (e.g., phenyl, naphthyl), more preferably a phenyl or naphthyl group, and still more preferably a phenyl group. The heterocyclic group represented by $Q_2$ is a 3- to 10-membered, saturated or unsaturated heterocyclic group containing at least one of N, O and S, which may be a monocyclic or condensed with another ring to a condensed ring.

The heterocyclic group is preferably a 5- or 6-membered unsaturated heterocyclic group, which may be condensed, more preferably a 5- or 6-membered aromatic heterocyclic group, which may be condensed, still more preferably a N-containing 5- or 6-membered aromatic heterocyclic group, which may be condensed, and optimally a 5- or 6-membered aromatic heterocyclic group containing one to four N atoms, which may be condensed. Exemplary examples of heterocyclic rings included in the heterocyclic group include imidazole, pyrazole, pyridine, pyrimidine, pyrazine, pyridazine, triazole, triazines, indole, indazole, purine, thiazole, oxadiazole, quinoline, phthalazine, naphthyridine, quinoxaline, quinazoline, cinnoline, pteridine, acrydine, phenanthroline, phenazine, tetrazole, thiazole, oxazole, benzimidazole, benzoxazole, benzthiazole, indolenine and tetrazaindene. Of these are preferred imidazole, pyridine, pyrimidine, pyrazine, pyridazine, triazole, triazines, thiadiazole, oxadiazole, quinoline, phthalazine, naphthylizine, quinoxaline, quinazoline, cinnoline, tetrazole, thiazole, oxazole, benzimidazole, and tetrazaindene; more preferably imidazole, pyrimidine, pyridine, pyrazine, pyridazine, triazole, triazines, thiadiazole, quinoline, phthalazine, naphthyridine, quinoxaline, quinazoline, cinnoline, tetrazole, thiazole, benzimidazole, and benzthiazole; and still more preferably pyridine, thiazole, quinoline and benzthiazole.

The aryl group or heterocyclic group represented by Q may be substituted by a substituent, in addition to —Y—C($X_1$)($X_2$)($X_3$). Preferred examples of the substituent include an alkyl group, an alkenyl group, an aryl group, an alkoxyl group, an aryloxyl group, an acyloxy group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a ureido group, phosphoramido group, a halogen atom, cyano group, sulfo group, carboxy group, nitro group and heterocyclic group of these are preferred an alkyl group, an aryl group, an alkoxyl group, an aryloxyl group, an acyl group, an acylamino group, an aryloxyl group, acyl group, an acylamino group, an alkoxycarbonyl group, an aryloxycarbonylamino group, a sulfonylamino group, a sulfamoyl group, a carbamoyl group, a ureido group, phosphoramido group, a halogen atom, cyano group, nitro group, and a heterocyclic group; and more preferably an alkyl group, an aryl group, an alkoxyl group, an aryloxyl group, an acyl group, an acylamino group, a sulfonylamino group, a sulfamoyl group, a carbamoyl group, a halogen group, cyano group, nitro group and a heterocyclic group; and still more preferably an alkyl group, an aryl group and a halogen atom. $X_1$, $X_2$ and $X_3$ are preferably a halogen atom, a haloalkyl group, an acyl group, an alkoxycarbonyl group, an aryloxycarbonyl group, a carbamoyl group, a sulfamoyl group, a sulfonyl group, and a heterocyclic group, more preferably a halogen atom, a haloalkyl group, an acyl group, an alkoxycarbonyl group, an aryloxycarbonyl group, and a sulfonyl group; and still more preferably a halogen atom and trihalomethyl group; and most preferably a halogen atom. Of halogen atoms are preferably chlorine atom, bromine and iodine atom, and more preferably chlorine atom and bromine atom, and still more preferably bromine atom. Y is —C(=O)—, —SO—, and —$SO_2$—, and preferably —$SO_2$—.

The amount of this compound to be incorporated is preferably within the range in which an increase of printed-out silver caused by formation of silver halide becomes substantially no problem, more preferably not more than 150% by weight and still more preferably not more than 100% by weight, based on the compound releasing no active halogen atom.

Further, in addition to the foregoing compounds, compounds commonly known as an antifoggant may be incorporated in the photothermographic imaging material used in the invention. In such a case, the compounds may be those which form a labile species similarly to the foregoing compounds or those which are different in antifogging mechanism. Examples thereof include compounds described in U.S. Pat. Nos. 3,589,903, 4,546,075 and 4,452,885; JP-A No. 59-57234; U.S. Pat. Nos. 3,874,946 and 4,756,999; and JP-A Nos. 9-288328 and 9-90550. Further, other antifoggants include, for example, compounds described in U.S. Pat. No. 5,028,523 and European patent Nos. 600,587, 605,981 and 631,176.

In the invention, at least one of reducing agents for silver ions preferably is a bisphenol derivative, which may be used alone or in combination with other reducing agents. The reducing agent used in the invention preferably is a bisphenol derivative represented by the following formula (A):

formula (A)

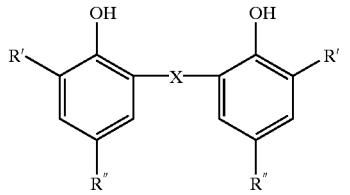

wherein X represents a chalcogen atom or CHR, in which R is a hydrogen atom, a halogen atom an aliphatic group having 7 or less carbon atoms or a 6- or less-membered cycle group; and R' and R" are each a hydrogen atom, a halogen atom or a substituent. The chalcogen atom represented by X is sulfur, selenium, or tellurium atom, in which sulfur atom is preferred.

R is a hydrogen atom, a halogen atom an aliphatic group having 7 or less carbon atoms or a 6- or less-membered cycle group. Examples of the halogen atom include a fluorine atom, chlorine atom and bromine atom. Examples of the aliphatic group having 7 or less carbon atoms include methyl, ethyl, propyl, butyl, hexyl, heptyl, vinyl, allyl, butenyl, hexadienyl, etenyl-2-propenyl, 3-butenyl, 1-methyl-3-propenyl, 3-pentenyl and 1-methyl-3-pentenyl. The 6- or less-membered cycle groups include an acyclic group, heterocyclic group and carbocyclic group, in which 4- to 6-membered alicyclic groups such as cyclobutene, cyclopentyl, cyclopentenyl, cyclohexyl, cyclohexenyl, cyclohexadienyl, and phenyl are preferred; as a heterocyclic ring forming the heterocyclic group are preferred a pyrazolo ring, pyrrole ring, pyrrolidine ring, pyrimidine ring, pyrazine ring, pyridine ring, triazine ring, thiazole ring, furan ring, and pyrane ring. A hydrogen atom and a cyclic group of cycloalkyl, cycloalkenyl and phenyl are specifically preferred.

The foregoing groups may be substituted. Examples of substituent groups include a halogen atom (e.g., fluorine, chlorine, bromine), cycloalkyl group (e.g., cyclohexyl, cycloheptyl), cycloalkenyl group (e.g., 1-cyclalkenyl, 2-cycloalkenyl), alkoxy group (e.g., methoxy, ethoxy, propoxy), alkylcarbonyloxy group (e.g., acetyloxy), alkylthio group (e.g., methylthio, trifluoromethylthio), carboxyl group, alkylcarbonylamino group (e.g., acetylamino), ureido group (e.g., methylaminocarbonylamino), alkylsulfonyl group (e.g., methanesulfonyl, trifluoromethanesulfonyl), carbamoyl group (e.g., carbamoyl, N,N-dimethylcarbamoyl, N-morpholinocarbonyl), sulfamoyl group (e.g., sulfamoyl, N,N-dimethylsulfamoyl, morpholinosulfamoyl), trifluoromethyl, hydroxy, nitro, cyano, alkylsulfonamido group (e.g., methanesulfonamido, butanesulfoneamido), alkylamino group (e.g., N,N-dimethylamino, N,N-diethylamino), sulfo group, phosphono group, sulfite group, sulfino group, alkylsulfonylaminocarbonyl group (e.g., methanesulfonylaminocarbonyl, ethanesulfonylaminocarbonyl), alkylcarbonylaminosulfonyl group (e.g., acetoamidosulfonyl, methoxyacetoamidosulfonyl), alkynylaminocarbonyl group (e.g., acetoamidocarbonyl, methoxyacetoamidocarbonyl), and alkylsulfinylaminocarbonyl group (e.g., methanesulfinylaminocarbonyl, ethane sulfinylaminocarbonyl). In the case of plural substituent groups, they may be the same of different.

R' and R" are each a hydrogen atom, halogen atom or substituent. Examples of the halogen atom include fluorine, chlorine and bromine. Examples of the substituent include an alkyl group, aryl group, cycloalkyl group, alkenyl group, cycloalkenyl group, alkynyl group, amino group, acyl group, acyloxy group, acylamino group, sulfonylamino group, sulfamoyl group, carbamoyl group, alkylthio group, sulfonyl group, alkylsulfonyl group, sulfinyl group, cyano, and heterocyclic group. Plural R's or R"s may be the same or different. R' preferably has 2 or more carbon atoms; R" preferably having 1 to 5 carbon atoms and more preferably one carbon atom.

The foregoing groups may be substituted. Examples of substituent groups include a halogen atom (e.g., fluorine, chlorine, bromine), cycloalkyl group (e.g., cyclohexyl, cycloheptyl), cycloalkenyl group (e.g., 1-cyclalkenyl, 2-cycloalkenyl), alkoxy group (e.g., methoxy, ethoxy, propoxy), alkylcarbonyloxy group (e.g., acetyloxy), alkylthio group (e.g., methylthio, trifluoromethylthio), carboxyl group, alkylcarbonylamino group (e.g., acetylamino), ureido group (e.g., methylaminocarbonylamino), alkylsulfonyl group (e.g., methanesulfonyl, trifluoromethanesulfonyl), carbamoyl group (e.g., carbamoyl, N,N-dimethylcarbamoyl, N-morpholinocarbonyl), sulfamoyl group (e.g., sulfamoyl, N,N-dimethylsulfamoyl, morpholinosulfamoyl), trifluoromethyl, hydroxy, nitro, cyano, alkylsulfonamido group (e.g., methanesulfonamido, butanesulfoneamido), alkylamino group (e.g., N,N-dimethylamino, N,N-diethylamino), sulfo group, phosphono group, sulfite group, sulfino group, alkylsulfonylaminocarbonyl group (e.g., methanesulfonylaminocarbonyl, ethanesulfonylaminocarbonyl), alkylcarbonylaminosulfonyl group (e.g., acetoamidosulfonyl, methoxyacetoamidosulfonyl), alkynylaminocarbonyl group (e.g., acetoamidocarbonyl, methoxyacetoamidocarbonyl), and alkylsulfinylaminocarbonyl group (e.g., methanesulfinylaminocarbonyl, ethane sulfinylaminocarbonyl).

Specific examples of the compound represented by formula (A) are shown below.
(1-1)
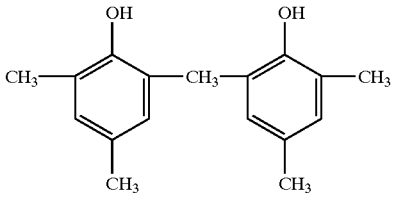
(1-2)
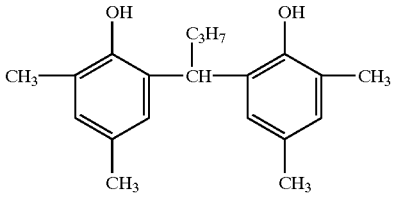
(1-3)
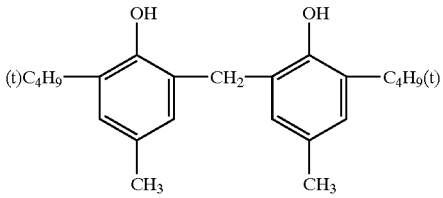
(1-4)
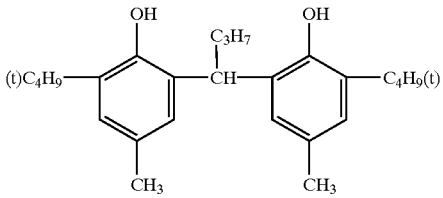
(1-5)
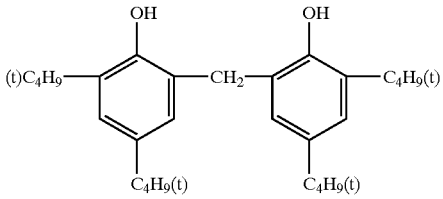
(1-6)
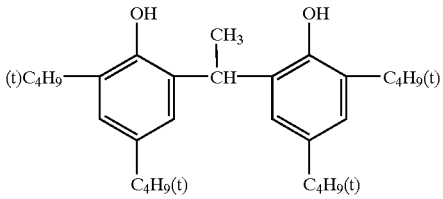
(1-7)
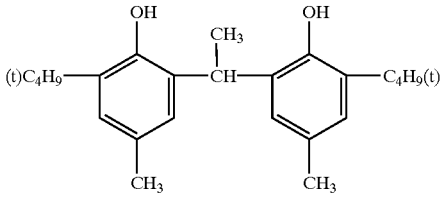
-continued
(1-8)
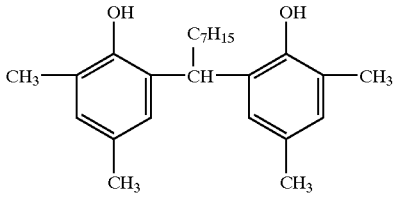
(1-9)
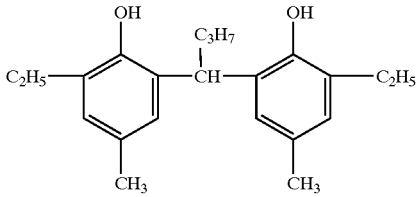
(1-10)
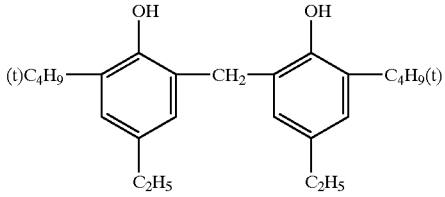
(1-11)
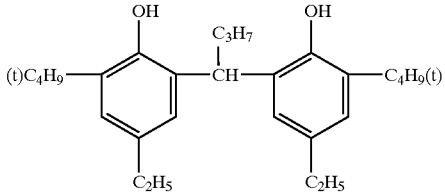
(1-12)
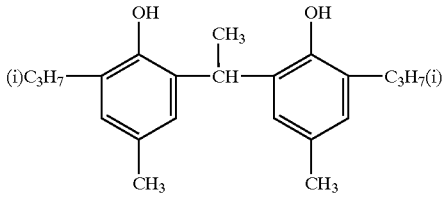
(1-13)
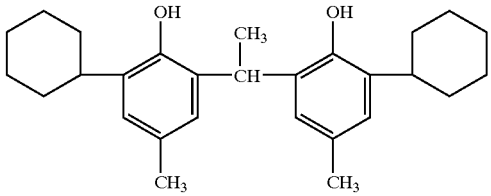
(1-14)
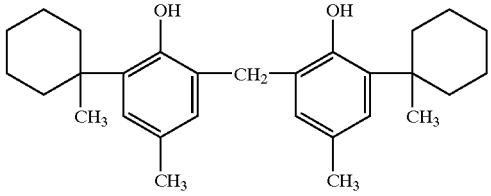

-continued
(1-15)
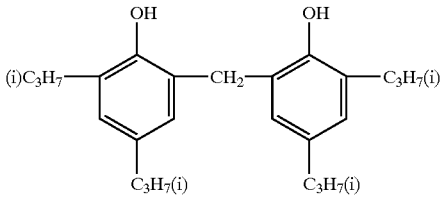
(1-16)
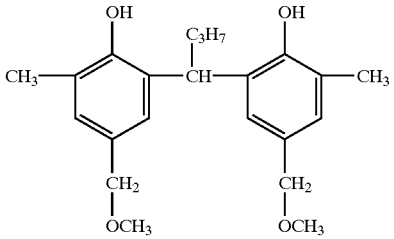
(1-17)
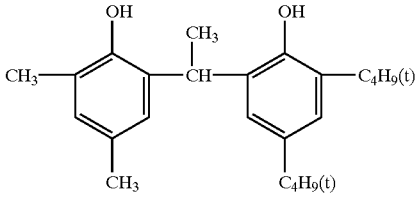
(1-18)
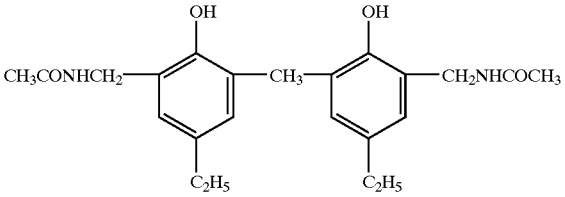
(1-19)
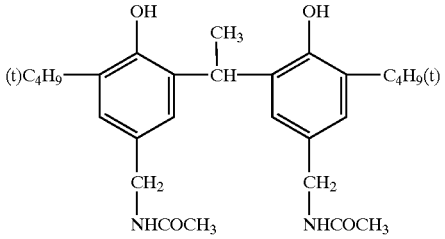
(1-20)
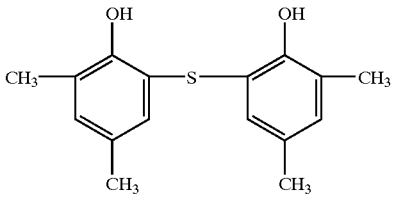
(1-21)
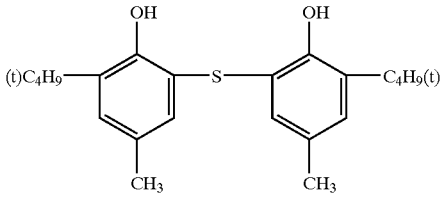
-continued
(1-22)
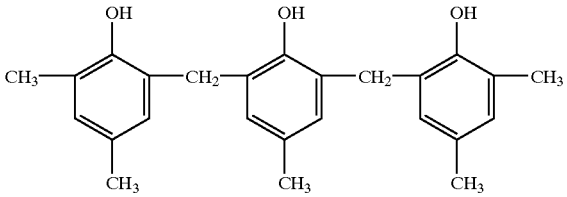
(1-23)
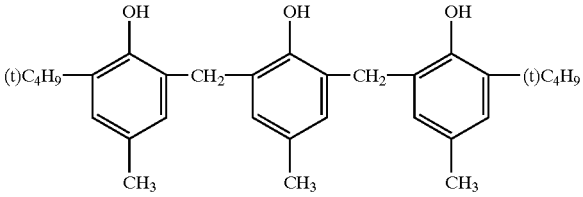
(1-24)
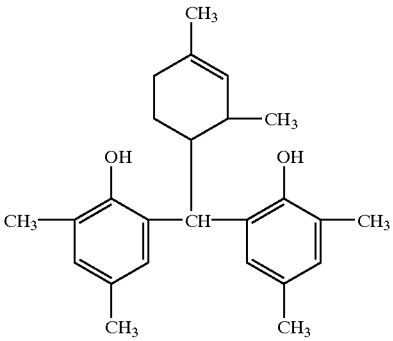
(1-25)
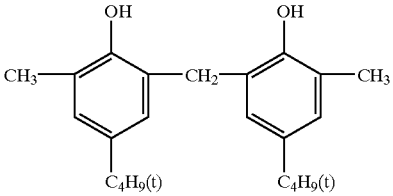
(1-26)
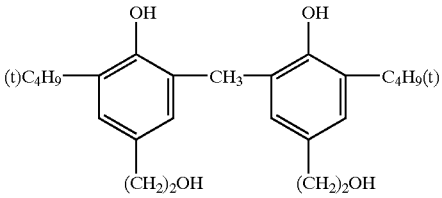
(1-27)
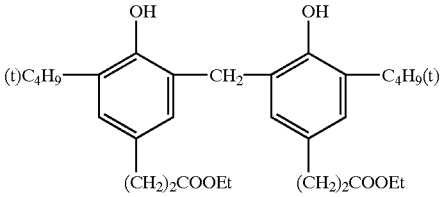
(1-28)
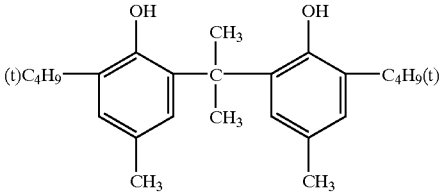

-continued (1-29)

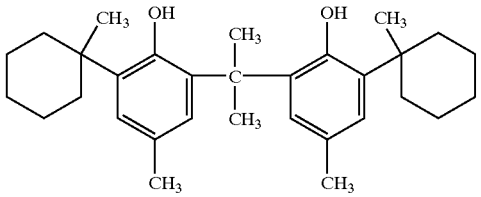

(1-30)

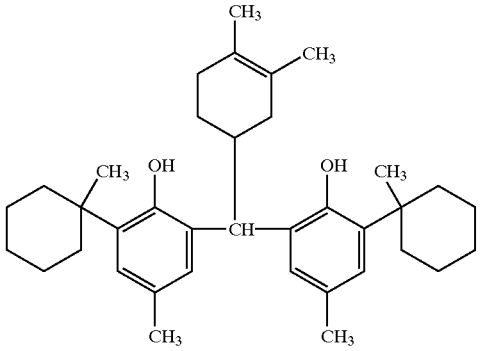

In addition to the foregoing compounds, examples of the reducing agents include polyphenol compounds described in U.S. Pat. Nos. 3,589,903 and 4,021,249; British patent No. 1,486,148; JP-A Nos. 51- 51933, 50-36110, 50-116023 and 52-84727; JP-B No. 51-35727 (hereinafter, the term, JP-B means a published Japanese Patent); bisnaphthols described in U.S. Pat. No. 3,672,904, such as 2,2'-dihydroxy-1,1'-binaphthyl and 6,6'-dibromo-2,2'-dihydoxy-1,1'-binaphthyl; sulfonamidophenols and sulfonamidonaphthols described in U.S. Pat. No. 3,801,321, such as 4-benzenesulfonamidophenol, 2-benzenesulfon-amidophenol, 2,6-dichloro-4-benzenesulfonamidophenol and 4-benzenesulfonamidonaphthol.

The amount of a reducing agent to be used, such as the compound represented by formula (A) is preferably $1\times10^{-2}$ to 10 mol and more preferably $1.5\times10^{-2}$ to 1.5 mol per mol silver. Two or more reducing agents may be used in combination, in an amount within the foregoing range.

Addition of the reducing agent to a light sensitive emulsion comprising a light sensitive silver halide, organic silver salt grains and a solvent immediately before coating the emulsion is often preferred, thereby minimizing variation in photographic performance during standing.

Silver halide grains used in the invention can be subjected to chemical sensitization. In accordance with methods described in Japanese Patent Application Nos. 2000-57004 and 2000-61942, for example, a chemical sensitization center (chemical sensitization speck) can be formed using compounds capable of releasing chalcogen such as sulfur or noble metal compounds capable of releasing a noble metal ion such as a gold ion. In the invention, it is preferred to conduct chemical sensitization with an organic sensitizer containing a chalcogen atom, as described below. Such a chalcogen atom-containing organic sensitizer is preferably a compound containing a group capable of being adsorbed onto silver halide and a labile chalcogen atom site. These organic sensitizers include, for example, those having various structures, as described in JP-A Nos. 60-150046, 4-109240 and 11-218874. Specifically preferred of these is at least a compound having a structure in which a chalcogen atom is attacked to a carbon or phosphorus atom through a double bond. The amount of a chalcogen compound added as an organic sensitizer is variable, depending on the chalcogen compound to be used, silver halide grains and a reaction environment when subjected to chemical sensitization and is preferably $10^{-8}$ to $10^{-2}$ mol, and more preferably $10^{-7}$ to $10^{-3}$ mol per mol of silver halide. In the invention, the chemical sensitization environment is not specifically limited but it is preferred to conduct chemical sensitization in the presence of a compound capable of eliminating a silver chalcogenide or silver specks formed on the silver halide grain or reducing the size thereof, or specifically in the presence of an oxidizing agent capable of oxidizing the silver specks, using a chalcogen atom-containing organic sensitizer. To conduct chemical sensitization under preferred conditions, the pAg is preferably 6 to 11, and more preferably 7 to 10, the pH is preferably 4 to 10 and more preferably 5 to 8, and the temperature is preferably not more than 30° C.

In photothermographic imaging materials used in the invention, it is preferred to use a light sensitive emulsion, in which light sensitive silver halide has been subjected to chemical sensitization using a chalcogen atom-containing organic sensitizer at a temperature of 30° C. or higher, concurrently in the presence of an oxidizing agent capable of oxidizing silver specks formed on the silver halide grains, then, mixed with an organic silver salt, dehydrated and dried.

Chemical sensitization using the foregoing organic sensitizer is also preferably conducted in the presence of a spectral sensitizing dye or a heteroatom containing compound capable of being adsorbed onto silver halide grains. Thus, chemical sensitization in the present of such a silver halide-adsorptive compound results in prevention of dispersion of chemical sensitization center specks, thereby achieving enhanced sensitivity and minimized fogging. Although there will be described spectral sensitizing dyes used in the invention, preferred examples of the silver halide-adsorptive, heteroatom-containing compound include nitrogen containing heterocyclic compounds described in JP-A No. 3-24537. In the heteroatom-containing compound, examples of the heterocyclic ring include a pyrazolo ring, pyrimidine ring, 1,2,4-triazole ring, 1,2,3-triazole ring, 1,3,4-thiazole ring, 1,2,3-thiadiazole ring, 1,2,4-thiadiazole ring, 1,2,5-thiadiazole ring, 1,2,3,4-tetrazole ring, pyridazine ring, 1,2,3-triazine ring, and a condensed ring of two or three of these rings, such as triazolotriazole ring, diazaindene ring, triazaindene ring and pentazaindene ring. Condensed heterocyclic ring comprised of a monocycic hetero-ring and an aromatic ring include, for example, a phthalazine ring, benzimidazole ring indazole ring, and benzthiazole ring. Of these, an azaindene ring is preferred and hydroxy-substituted azaindene compounds, such as hydroxytriazaindene, tetrahydroxyazaindene and hydroxypentazaundene compound are more preferred. The heterocyclic ring may be substituted by substituent groups other than hydroxy group. Examples of the substituent group include an alkyl group, substituted alkyl group, alkylthio group, amino group, hydroxyamino group, alkylamino group, dialkylamino group, arylamino group, carboxy group, alkoxycarbonyl group, halogen atom and cyano group. The amount of the heterocyclic ring containing compound to be added, which is broadly variable with the size or composition of silver halide grains, is within the range of $10^{-6}$ to 1 mol, and preferably $10^{-4}$ to $10^{-1}$ mol per mol silver halide.

As described earlier, silver halide grains can be subjected to noble metal sensitization using compounds capable of releasing noble metal ions such as a gold ion. Examples of usable gold sensitizers include chloroaurates and organic gold compounds. In addition to the foregoing sensitization, reduction sensitization can also be employed and exemplary compounds for reduction sensitization include ascorbic acid, thiourea dioxide, stannous chloride, hydrazine derivatives, borane compounds, silane compounds and polyamine compounds. Reduction sensitization can also conducted by ripening the emulsion while maintaining the pH at not less than 7 or the pAg at not more than 8.3. Silver halide to be subjected to chemical sensitization may be one which has been prepared in the presence of an organic silver salt, one which has been formed under the condition in the absence of the organic silver salt, or a mixture thereof.

Light sensitive silver halide grains used in the invention are preferably subjected to spectral sensitization by allowing a spectral sensitizing dye to adsorb to the grains. Examples of the spectral sensitizing dye include cyanine, merocyanine, complex cyanine, complex merocyanine, holo-polar cyanine, styryl, hemicyanine, oxonol and hemioxonol dyes, as described in JP-A Nos. 63-159841, 60-140335, 63-231437, 63-259651, 63-304242, 63-15245; U.S. Pat. Nos. 4,639,414, 4,740,455, 4,741,966, 4,751,175 and 4,835,096. Usable sensitizing dyes are also described in Research Disclosure (hereinafter, also denoted as RD) 17643, page 23, sect. IV-A (December, 1978), and ibid 18431, page 437, sect. X (August, 1978). It is preferred to use sensitizing dyes exhibiting spectral sensitivity suitable for spectral characteristics of light sources of various laser imagers or scanners. Examples thereof include compounds described in JP-A Nos. 9-34078, 9-54409 and 9-80679.

Useful cyanine dyes include, for example, cyanine dyes containing a basic nucleus, such as thiazoline, oxazoline, pyrroline, pyridine, oxazole, thiazole, selenazole and imidazole nuclei. Useful merocyanine dyes preferably contain, in addition to the foregoing nucleus, an acidic nucleus such as thiohydatoin, rhodanine, oxazolidine-dione, thiazolinedione, barbituric acid, thiazolinone, malononitrile and pyrazolone nuclei. In the invention, there are also preferably used sensitizing dyes having spectral sensitivity within the infrared region. Examples of the preferred infrared sensitizing dye include those described in U.S. Pat. Nos. 4,536,478, 4,515,888 and 4,959,294.

The infrared sensitizing dye according to the invention is preferably a dye characterized in that the dye is a long chain polymethine dye, in which a sulfonyl group is substituted on the benzene ring of the benzothiazole ring.

The infrared sensitizing dyes and spectral sensitizing dyes described above can be readily synthesized according to the methods described in F. M. Hammer, The Chemistry of Heterocyclic Compounds vol.18, "The cyanine Dyes and Related Compounds" (A. Weissberger ed. Interscience Corp., New York, 1964).

The infrared sensitizing dyes can be added at any time after preparation of silver halide. For example, the dye can be added to a light sensitive emulsion containing silver halide grains/organic silver salt grains in the form of by dissolution in a solvent or in the form of a fine particle dispersion, so-called solid particle dispersion. Similarly to the heteroatom containing compound having adsorptivity to silver halide, after adding the dye prior to chemical sensitization and allowing it to be adsorbed to silver halide grains, chemical sensitization is conducted, thereby preventing dispersion of chemical sensitization center specks and achieving enhanced sensitivity and minimized fogging.

These sensitizing dyes may be used alone or in combination thereof. The combined use of sensitizing dyes is often employed for the purpose of supersensitization. A supersensitizing compound, such as a dye which does not exhibit spectral sensitization or substance which does not substantially absorb visible light may be incorporated, in combination with a sensitizing dye, into the emulsion containing silver halide grains and aliphatic carboxylic acid silver salt grains used in photothermographic imaging materials of the invention.

Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432. In the invention, an aromatic heterocyclic mercapto compound represented by the following formula (6) is preferred as a supersensitizer:

Ar—SM wherein M is a hydrogen atom or an alkali metal atom; Ar is an aromatic ring or condensed aromatic ring containing a nitrogen atom, oxygen atom, sulfur atom, selenium atom or tellurium atom.

Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included:

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

Ar—S—S—Ar Formula (7)

wherein Ar is the same as defined in formula (6).

The aromatic heterocyclic rings described above may be substituted with a halogen atom (e.g., Cl, Br, I), a hydroxy group, an amino group, a carboxy group, an alkyl group (having one or more carbon atoms, and preferably 1 to 4 carbon atoms) or an alkoxy group (having one or more carbon atoms, and preferably 1 to 4 carbon atoms).

In addition to the foregoing supersensitizers, a compound described in Japanese Patent Application No. 2000-70296, represented by the following formula [5] and a macrocyclic compound can also employed as a supersensitizer in the invention:

formula [5]

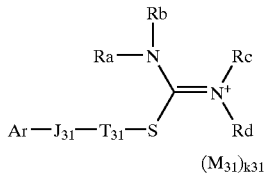

wherein Ar represent an aromatic hydrocarbon group or an aromatic heterocyclic group; $T_{31}$ represents a bivalent aliphatic hydrocarbon linkage group or a linkage group; $J_{31}$ represents a bivalent linking group containing at least one of an oxygen atom, sulfur atom and nitrogen atom, or a direct bond; Ra, Rb, Rc and Rd each represent a hydrogen atom, an acyl group, an aliphatic hydrocarbon group, an aryl group or a heterocyclic group, or Ra and Rb, Rc and Rd, Ra and Rc, or Rb and Rd combine with each other to form a nitrogen containing ring; $M_{31}$ represents an ion necessary to neutralize an intramolecular charge; and $k_{3-}$ represents the number of the ion necessary to neutralize an intramolecular charge.

In the formula [5], the bivalent, aliphatic hydrocarbon linkage group represented by $T_{31}$ include a straight-chain, branched cyclic alkylene group (preferably having 1 to 20 carbon atoms, more preferably 1 to 16 carbon atoms, and still more preferably 1 to 12 carbon atoms), an alkenylene group (preferably having 2 to 20 carbon atoms, more preferably 2 to 16 carbon atoms, and still more preferably 2 to 12 carbon atoms), an alkynylene group (preferably having 2 to 20 carbon atoms, more preferably 2 to 16 carbon atoms, and still more preferably 2 to 12 carbon atoms), each of which may be substituted by substituent group(s). The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms , and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. These groups each may be substituted at any position. Examples of such substituent groups include an alkyl group (including a cycloalkyl group and an aralkyl group, and preferably having 1 to 20 carbon atoms, more preferably 1 to 12 carbon atoms and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, 3-pentenyl, etc.), an alkynyl (preferably having 2 to 20 carbon atoms, more preferably 2 to 12 carbon atoms and still more preferably 2 to 8 carbon atoms, e.g., propargyl, 3-pentynyl, etc.), aryl group (preferably having 6 to 30 carbon atoms, more preferably 6 to 20 carbon atoms, and still more preferably 6 to 12 carbon atoms, e.g., phenyl, p-tolyl, o-aminophenyl, naphthyl), an amino group (preferably having 0 to 20 carbon atoms, more preferably 0 10 carbon atoms, and still more preferably 0 to 6 carbon atoms, e.g., amino, methylamino, ethylamino, dimethylamino, diethylamino, diphenylamino, dibenzylamino, etc.), an imino group (preferably having 1 to 20 carbon atoms, more preferably 1 to 18 carbon atoms, and still more preferably 1 to 12 carbon atoms, e.g., methylimino, ethylimino, propylimino, phenylimino), an alkoxy group (preferably having 1 to 20 carbon atoms, more preferably 1 to 12 carbon atoms, and still more preferably 1 to 8 carbon atoms, e.g., methoxy, ethoxy, butoxy, etc.), an aryloxy group (preferably having 6 to 20 carbon atoms, more preferably 6 to 16 carbon atoms and still more preferably 6 to 12 carbon atoms, e.g., phenyloxy, 2-naphthyloxy, etc.), an acyl group (preferably having 1 to 20 carbon atoms, more preferably 1 to 16 carbon atoms, and still more preferably 1 to 12 carbon atoms, e.g., acetyl, formyl, pivaloyl, benzoyl, etc.), an alkoxycarbonyl group (preferably having 2 to 20 carbon atoms, more preferably 2 to 16 carbon atoms, and still more preferably 2 to 12 carbon atoms, e.g., methoxycarbonyl, ethoxycarbonyl, etc.), an aryloxycarbonyl group (preferably having 7 to 20 carbon atoms, more preferably 7 to 16 carbon atoms, and still more preferably 7 to 10 carbon atoms, e.g., phenyloxycarbonyl, etc.), an acyloxy group (preferably having 1 to 20 carbon atoms, more preferably 1 to 16 carbon atoms and still more preferably 1 to 10 carbon atoms, e.g., acetoxy, benzoyloxy, etc.), an acylamino group (preferably having 1 to 20 carbon atoms, more preferably 1 to 16 carbon atoms, and still more preferably 1 to 10 carbon atoms, e.g., acetylamino, benzoylamino, etc.), an alkoxycarbonylamino group (preferably having 2 to 20 carbon atoms, more preferably 2 to 16 carbon atoms, and still more preferably 2 to 12 carbon atoms, e.g., methoxycarbonylamino, etc.), an aryloxycarbonylamino group (preferably having 7 to 20 carbon atoms, more preferably 7 to 16 carbon atoms, and still more preferably 7 to 12 carbon atoms, e.g., phenyloxycarbonylamino, etc.), a sulfonylamino group (preferably having 1 to 20 carbon atoms, more preferably 1 to 16 carbon atoms, and still more preferably 1 to 12 carbon atoms, e.g., methanesulfonylamino, benzenesulfonylamino, etc.), a sulfamoyl group (preferably having 0 to 20 carbon atoms, more preferably 0 to 16 carbon atoms, and still more preferably 0 to 12 carbon atoms, e.g., sulfamoyl, methylsulfamoyl, dimethylsulfamoyl, phenylsulfamoyl, etc.), a carbamoyl group (preferably having 1 to 20 carbon atoms, more preferably 1 to 16 carbon atoms, and still more preferably 1 to 12 carbon atoms, e.g., carbamoyl, methylcarbamoyl, diethylcarbamoyl, phenylcarbamoyl, etc.), an alkylthio group (preferably having 1 to 20 carbon atoms, more preferably 1 to 16 carbon atoms, and still more preferably 1 to 12 carbon atoms, e.g., methylthio, ethylthio, etc.), arylthio group (preferably having 6–20 carbon atoms, more preferably 6 to 16 carbon atoms and still more preferably 6 to 12 carbon atoms, e.g., phenylthio), an alkylsulfonyl or arylsulfonyl group (preferably having 1 to 20 carbon atom, more preferably 1 to 16 carbon atoms, and still more preferably 1 to 12 carbon atoms, e.g., methanesulfonyl, tosyl) an alkylsulfonyl or arylsulfinyl group (preferably having 1 to 20 carbon atoms, more preferably 1 to 16 carbon atoms, and still more preferably 1 to 12 carbon atoms, e.g., methanesulfinyl, benzenesulfinyl, etc.), an ureido group (preferably having 1 to 20 carbon atoms, more preferably 1 to 16 carbon atoms and still more preferably 1 to 12 carbon atoms, e.g., ureido, methylureido, phenylureido, etc.), a phosphoric acid amido group (preferably having 1 to 20 carbon atoms, more preferably 1 to 16 carbon atoms, and still more preferably 1 to 12 carbon atoms, e.g., diethylphosphoric acid amido, phenylphosphoric acid amido, etc.), hydroxy group, mercapto group, a halogen atom (e.g., fluorine atom, chlorine atom, bromine atom, iodine atom), cyano group, sulfo group, sulfino group, carboxy group, phosphono group, phosphono group, nitro group, hydroxamic acid group, hydrazino group, and a heterocyclic group (e.g., imidazolyl, benzimidazolyl, thiazolyl, benzothiazolyl, carbazolyl, pyridyl, furyl, piperidyl, morphoryl. etc.).

Of these substituent groups described above, hydroxy group, mercapto group, sulfo group, sulfino group, carboxy group, phosphono group, and phosphino group include their salts. The substituent group may be further substituted. In this case, plural substituent may be the same or different. The preferred substituent groups include an alkyl group, aralkyl group, alkoxy group, aryl group, alkylthio group, acyl group, acylamino group, imino group, sulfamoyl group, sulfonyl group, sulfonylamino group, ureido group, amino group, halogen atom, nitro group, heterocyclic group, alkoxycarbonyl group, hydroxy group, sulfo group, carbamoyl group, and carboxy group. Specifically, an alkyl group, alkoxy group, aryl group, alkylthio group, acyl group, acylamino group, imino group, sulfonylamino group, ureido group, amino group, halogen atom nitro group, heterocyclic group, alkoxycarbonyl group, hydroxy group, sulfo group, carbamoyl group and carboxy group are more preferred; and an alkyl group, alkoxy group, aryl group, alkylthio group, acylamino group, imino group, ureido group, amino group, heterocyclic group, alkoxycarbonyl group, hydroxy group, sulfo group, carbamoyl group and carboxy group are still more preferred. The amidino group include a substituted one and examples of the substituent group include an alkyl group (e.g., methyl, ethyl, pyridylmethyl, benzyl, phenethyl, carboxybenzyl, aminophenylmethyl, etc.), an aryl group (e.g., phenyl, p-tolyl, naphthyl, o-aminophenyl, o-methoxyphenyl, etc.), and a heterocyclic group (e.g., 2-thiazolyl, 2-pyridyl, 3-pyridyl, 2-furyl, 3-furyl, 2-thieno, 2-imidazolyl, benzothiazolyl, carbazolyl, etc.).

Examples of a bivalent linking group containing at least one of an oxygen atom, sulfur atom and nitrogen atom, represented by $J_{31}$ include the following groups, which may be combined:

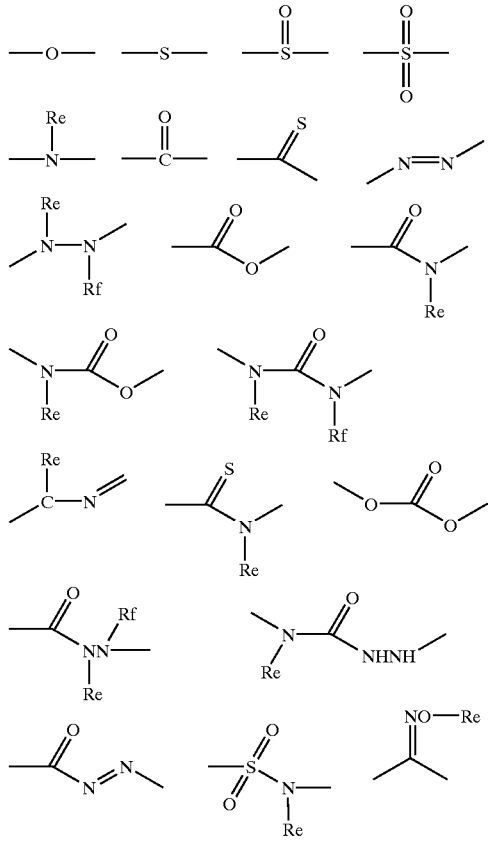

wherein Re and Rf are the same as defined in Ra through Rd. The aromatic hydrocarbon group represented by Ar is a monocyclic or condensed aryl group (preferably having 6 to 30 carbon atoms, and more preferably 6 to 20 carbon atoms). Examples thereof include phenyl and naphthyl, and phenyl is preferred. The aromatic heterocyclic group represented by $ArH_{31}$ is a 5- to 10-membered unsaturated heterocyclic group containing at least one of N, O and S, which may be monocyclic or condensed with other ring.

A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen- containing, 5- or 6-membered aromatic heterocyclic ring or its benzo-condensed ring.

Examples of the aromatic heterocyclic group include groups derived from chiophene, furan, pyrrole, imidazole, pyrazolo, pyridine, pyrazine, pyridazine, triazole, triazine, indole, indazole, purine, thiadiazole, oxadiazole, quinoline, phthalazine, naphthylizine, quinoxaline, quinazolone, cinnoline, pteridine, acrydine, phenathroline, phenazine, tetrazole, thiazole, oxazole, benzimidazole, benzoxazole, benzthiazole, benzothiazoline, benzotriazole, tetrazaindene, and carbazole. Of these, groups derived from imidazole, pyrazolo, pyridine, pyrazine, indole, indazole, thiadiazole, oxadiazole, quinoline, phenazine, tetrazole, thiazole, oxazole, benzimidazole, benzoxazole, benzthiazole, benzothiazoline, benzotriazole, tetrazaindene, and carbazole are preferred; and groups derived from imidazole, pyridine, pyrazine, quinoline, phenazine, tetrazole, thiazole, benzoxazole, benzoimidazole, benzthiazole, benzothiazoline, benzotriazole, and carbazole are more preferred.

The aromatic hydrocarbon group and aromatic heterocyclic group represented by Ar may be substituted. The substituent group is the same as the substituent groups defined in $T_{31}$. The substituent group may be further substituted, and plural substituting group may be the same or different. Further, the group represented by $ArH_{31}$ is preferably an aromatic heterocyclic group.

The aliphatic hydrocarbon group represented by Ra, Rb, Rc, Rd, Re and Rf include, for example, an alkyl group (preferably having 1 to 20 carbon atoms, more preferably 1 to 16 carbon atoms and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl (preferably having 2 to 20 carbon atoms, more preferably 2 to 16 carbon atoms, and still more preferably 2 to 12 carbon atoms) an aryl group (preferably having 6 to 30 carbon atoms, more preferably 6 to 20 carbon atoms, and still more preferably 6 to 12 carbon atoms, e.g., phenyl, naphthyl), and a heterocyclic group (e.g., 2-thiazolyl, 1-piperadynyl, 2-pyridyl, 3-pyridyl,2-thienyl, 2-benzimidazolyl, carbazolyl, etc.). The heterocyclic group may be a monocyclic ring or a ring condensed with other ring. The acyl group represented by Ra, Rb, Rc, Rd, Re and Rf includes an aliphatic or aromatic one, such as acetyl, benzoyl, formyl, and pivaloyl. The nitrogen containing heterocyclic group formed by combination of Ra and Rb, Rc and Rd, Ra and Rc, or Rb and Rd includes a 3- to 10-membered, saturated or unsaturated heterocyclic ring (e.g., ring groups such as piperidine ring, piperazine ring, acridine ring, pyrrolidine ring, pyrrol ring and morphorine ring).

Examples of acid anions used as the ion necessary to neutralize an intramolecular charge, represented by $M_{31}$ include a halide ion (e.g., chloride ion, bromide ion, iodide ion, etc.), p-toluenesulfonate ion, perchlorate ion, tetrafluorobarate ion, sulfate ion, methylsulfate ion, ethylsulfate ion, methansufonic acid ion and trifluoromethanesulfonic acid ion.

The supersensitizer is incorporated into the emulsion layer containing an organic silver salt and silver halide grains, preferably in an amount of 0.001 to 1.0 mol, and more preferably 0.01 to 0.5 mol per mol of silver.

Bonders used in the silver salt photothermographic imaging material are transparent or translucent and generally colorless, including natural polymers, synthetic polymers or copolymers and film forming mediums. Exemplary examples thereof include gelatin, gum Arabic, polyvinyl alcohol, hydroxyethyl cellulose, cellulose acetate, cellulose acetate butyrate, polyvinyl pyrrolidine, casein, starch, polyacrylic acid, poly(methyl methacrylate), poly (methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic.

Of these, polyvinyl acetals are preferred as a binder used for the light sensitive layer, and polyvinyl acetal is specifically preferred binder. Further, for a light insensitive layer such as an over-coating layer or a sublayer, specifically, a protective layer or a back coating layer are preferred cellulose esters exhibiting a relatively high softening temperature, such as triacetyl cellulose and cellulose acetate-butyrate. The foregoing binders may optionally be used in combination.

The binder is used in an amount within the range effective to function as a binder. The effective range can be readily determined by one skilled in the art. As a measure to hold an organic silver salt in the light sensitive layer, the ratio by weight of a binder to an organic silver salt is preferably 15:1 to 1:2, and more preferably 8:1 to 1:1. Thus, the amount of a binder in the light sensitive layer is preferably 1.5 to 6 $g/m^2$, and more preferably 1.7 to 5 $g/m^2$. The amount of less than 1.5 $g/m^2$ results in an increase in unexposed areas, leading to levels unacceptable in practical use.

In one preferred embodiment of the invention, the thermal development temperature is 100 to 150° C.

The thermal transition temperature after thermal development is preferably 46 to 200° C. to achieve enhanced effects of the invention.

The thermal transition point is a value represented in Vicat softening point or a value represented in the ring and ball method, indicating an endothermic peak obtained when measuring the light-sensitive layer separated from the thermally developed photographic material, using a differential scanning calorimeter (or DSC, for example, EXSTAR 6000, available from SEIKO DENSHI KOGYO Co., Ltd.; DSC 220C, SEIKO DENSHI KOGYO Co., Ltd; and DSC-7, available from Perkin Elmer Co.). In general, polymeric compounds have a glass transition point (Tg). A large endothermic peak emerges at a temperature lower than the Tg value of binder resin used in the light-sensitive layer.

The glass transition point (Tg) can be determined in accordance with the method described in "Polymer Handbook" at page III-139 to III-179 (1966, published by Wirey and Sons).

In cases where the binder is a copolymer resin, Tg is defined by the following equation:

$$Tg(\text{copolymer})=v_1Tg_1+v_2Tg_2+\ldots+v_nTg_n$$

where $v_1$, $v_2$, . . . $v_n$ each represent a weight fraction of respective monomers of the copolymer; $Tg_1$, $Tg_2$, . . . $Tg_n$ each represent a glass transition point, Tg (° C.) of a homopolymer obtained by each of monomers constituting the copolymer.

In the photothermographic material relating to the invention, commonly known polymeric compounds as a binder containing aliphatic carboxylic acid silver salts, light-sensitive silver halide grains and a reducing agents. The glass transition point is preferably 70 to 105° C.; the number average molecular weight is preferably 1,000 to 1,000,000, and more preferably 10,000 to 500,000; and the degree of polymerization is preferably 50 to 1000. Examples thereof include compounds of a polymer or copolymer containing ethylenically unsaturated monomers as a constituting unit, such as vinyl chloride, vinyl acetate, vinyl alcohol, maleic acid, acrylic acid, acrylic acid ester, vinylidene chloride, acrylonitrile, methacrylic acid, methacrylic acid ester, styrene, butadiene, ethylene, vinyl butyral, vinyl acetal and vinyl ether; polyurethane resin, and various kinds of rubber resin. In addition thereto, phenol resin, epoxy resin, polyurethane thermally hardening type resin, urea resin, melamine resin, alkyd resin, formaldehyde resin, silicone resin, epoxy-polyamide resin, and polyester resin are also usable. These resins are detailed in "Plastic Handbook" published by Asakura-shoten. The foregoing polymeric compounds are not specifically limited and there is usable any one having a glass transition point (Tg) of 70 to 105° C., including homopolymers and copolymers.

Examples of polymer containing an ethylenically unsaturated monomer as a constituting unit and its copolymer include acrylic acid alkyl esters, acrylic acid aryl esters, methacrylic acid alkyl esters, methacrylic acid aryl esters, cyanoacrylic acid alkyl esters, and cyanoacrylic acid aryl esters, in which the alkyl or aryl group may be substituted. Examples of substituent groups include methyl, ethyl, n-propyl, isopropyl, n-butyl, isobutyl, sec-butyl, tert-butyl, amyl, hexyl, cyclohexyl, benzyl, chlorobenzyl, octyl, stearyl, sulfopropyl, N-ethyl-phenylethyl, 2-(3-phenylpropyloxy)ethyl, dimethylaminophenoxyethyl, furfuryl, tetrahydrofurfuryl, phenyl, cresyl, naphthyl, 2-hydroxyethyl, 4-hydroxybutyl, triethylene glycol, dipropylene glycol, 2-methoxyethyl, 3-methoxybutyl, 2-aetoxyethyl, 2-acetoxyacetoxyethyl, 2-ethoxyethyl, 2-isopropoxy, 2-butoxyethyl, 2-(2-methoxy)ethyl, 2-(2-ethoxyethoxy)ethyl, 2-(2-butoxyethoxy)ethyl, 2-diphenylphosphorylethyl, ω-methoxyethylene glycol (addition mole number n=6)allyl, and a dimethylaminoethyl chloride salt. In addition, the following monomers are also usable, including vinyl esters such as vinyl acetate, vinyl propionate, vinyl butyrate, vinyl isobutyrate, vinyl caproate, vinyl chloroacetate, vinyl methoxyacetate, vinyl phenylacetate, vinyl benzoate, and vinyl salicylate; N-substituted acrylamides, N-substituted methacrylamides, acrylamides and methacrylamides, in which N-substituting groups include, for example, methyl, ethyl, propyl, butyl, tert-butyl, cyclohexyl, benzyl, hydroxymethyl, methoxyethyl, dimethylaminoethyl, phenyl, dimethyl, diethyl, β-cyanoethyl, N-(2-acetoacetoxyethyl) and diacetone; olefins such as dicyclopentadiene, ethylene, propylene, 1-butene, 1-pentene, vinyl chloride, vinylidene chloride, isoprene, chloprene, butadiene, and 2,3-dimethylbutadiene; styrenes such as methylstyrene, dimethylstyrene, trimethylstyrene, ethylstyrene, isopropylstyrene, tert-butylstyrene, chloromethylstyrene, methoxystyrene, acetoxystyrene, chlorostyrene, dichlorostyrene, bromostyrene, and methyl vinylbenzoate; vinyl ethers such as methyl vinyl ether, butyl vinyl ether, hexyl vinyl ether, methoxyethyl vinyl ether, and dimethylaminoethyl vinyl ether; N-substituted maleimides, in which N-substituting groups include, for example, methyl, ethyl, propyl, butyl, tert-butyl, cyclohexyl, benzyl, n-dodecyl, phenyl, 2-methylphenyl, 2,6-diethylphenyland 2-chlorophenyl; and others such as butyl crotonate, hexyl crotonate, dimethylitaconate, dibutyl itaconate, diethyl maleate, dimetyl maleate, dibutyl maleate, diethyl fumarate, dimethyl fumarate, dibutyl fumarate, methyl vinyl ketone, phenyl vinyl ketone, methoxy ethyl ketone, glycidyl acrylate, glycidyl methacrylate, N-vinyl oxazolidone, N-vinyl pyrrolidone, acrylonitrile, methacrylonitrile, methylene malonitrile, and vinylidene chloride.

Of these polymer compounds are preferred methacrylic acid alkyl esters, methacrylic acid aryl esters and styrenes. Specifically, polymer compounds containing an acetal group are preferred, which are superior in miscibility with organic acids produced, preventing softening of the layer.

The polymer compound containing an acetal group is preferably represented by the following formula (V):

formula (V)

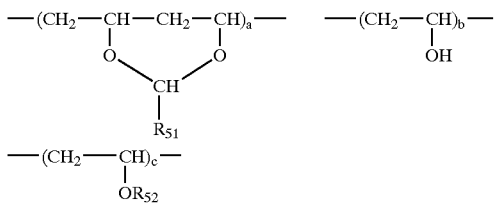

wherein $R_{51}$ is an unsubstituted alkyl group, a substituted alkyl group, an unsubstituted aryl group, and a substituted aryl group; $R_{52}$is an unsubstituted alkyl group, a substituted alkyl group, an unsubstituted aryl group, a substituted aryl group, —$COR_{53}$ or —$CONHR_{53}$, in which $R_3$ is the same as defined in $R_1$.

The unsubstituted alkyl group represented by $_{R51}$, $_{R52}$ and $_{R53}$ is preferably one having 1 to 20 carbon atoms, and more preferably 1 to 6 carbon atoms, which may be straight chain or branched, and preferably straight chain. Examples of such an unsubstituted alkyl group include methyl, ethyl, n-propyl, isopropyl, n-butyl, isobutyl, t-butyl, n-amyl, t-amyl, n-hexyl, cyclohexyl, n-heptyl, n-octyl, t-octyl, 2-ethylhexyl, n-nonyl, n-decyl, n-dodecyl, and n-octadecyl. Specifically, methyl or propyl group is preferred.

The unsubstituted aryl group is preferably one having 6 to 20 carbon atoms, such as phenyl or naphthyl. Examples of a group capable of being substituted on the alkyl or aryl group include an alkyl group (e.g., methyl, n-propyl, t-amyl, t-octyl, n-nonyl, dodecyl, etc.), aryl group (e.g., phenyl), nitro group, hydroxy group, cyano group, sulfo group, alkoxy group (e.g., methoxy), aryloxy group (e.g., phenoxy), acyloxy group (e.g., acetoxy), acylamino group (e.g., acetylamino), sulfonamido group (e.g., methanesulfonamido), sulfamoyl group (e.g., methylsufamoyl9, halogen atom (e.g., fluorine, chlorine, bromine atoms), carboxy group, carbamoyl group (e.g., methylcarbamoyl), alkoxycarbonyl group (e.g., methoxycarbonyl), and sulfonyl group (e.g., methylsufonyl). In cases where two or more substituent groups are contained, the substituent groups may be the same or different. The total number of carbon atoms of the substituted alkyl group is preferably 1 to 20, and that of the substituted aryl group is preferably 6 to 20.

$R_{52}$ is preferably —$COR_{53}$ (in which $R_3$ is an alkyl or aryl group) or —$CONHR_{53}$ (in which $R_3$ is an aryl group); a, b and c each are the weight of respective repeating units, expressed in terms of mol %, and a is 40 to 86 mol %, b is 0 to 30 mol % and c is 0 to 60 mol %, provided that a+b+c=100 mol %, a is preferably 50 to 86 mol %, b is preferably 5 to 25 mol % and c is preferably 0 to 40 mol %. The respective repeating units having composition ratio, a, b and c may be the same or different.

Polyurethane resins having commonly known structures are usable in the invention, such as polyester-polyurethane, polyether-polyurethane, polyether-polyester-polyurethanepolycarbonate-polyurethane, polyester-polycarbonate-polyurethane, and polycaprolactone-polyurethane. In the foregoing polyurethanes, at least one polar group selected from —COOM, —$SO_3M$, —$OSO_3M$, —P═O$(OM)_2$, —O—P═$(OM)_2$ (in which M is a hydrogen atom or an alkali metal salt), —$N(R_{54})_2$, —$N^+(R_{54})_3$ (in which $R_{54}$ is a hydrocarbon group), epoxy group, —SH, and —CN is preferably introduced in copolymerization or addition reaction. Such a polar group is preferably contained in an amount of $10^{-8}$ to $10^{-1}$ mol/g, and more preferably $10^{-6}$ to $10^{-2}$ mol/g. In addition to the polar group, it is preferred to contain at least one OH group on the end of a polyurethane molecule, i.e., at least two Oh groups in total. The OH group is capable of reacting with a polyisocyanate as a hardening agent to form a three-dimensional network structure so that the more is contained in the molecule, the more preferred. Specifically, the OH group on the molecular end, which exhibits relatively high reactivity is preferred. Polyurethane having at least three OH groups (and preferably at least four OH groups) on the molecular end is preferred. Specifically, polyurethane exhibiting a glass transition point of 70 to 105° C., a rupture elongation of 100 to 2000% and a rupture stress of 0.5 to 100 N/$mm^2$ is preferred.

Polymer compounds represented by the foregoing formula (V) can be synthesized in accordance with commonly known methods, as described, for example, in "Vinyl Acetate Resin" edited by Ichiro Sakurada (KOBUNSHIKAGAKU KANKOKAI, 1962).

These polymer compounds may be used singly or in a blended form of at least two thereof. The layer containing light-sensitive silver salt (preferably, light-sensitive layer) preferably contains the foregoing polymer compounds as a main binder. The main binder refers to the state in which at least 50% by weight of the total binder of the light-sensitive silver salt-containing layer is accounted for by the foregoing polymer. Accordingly, other polymer(s) may be blended within the range of less than 50% by weight of the total binder. Such polymer(s) are not specifically limited so long as a solvent capable of dissolving the foregoing polymer is used. Examples of such polymer(s) include polyvinyl acetate, polyacryl resin and polyurethane resin.

The composition of the foregoing polymers and a comparative polymer are shown below, in which Tg was determined using a differential scanning calorimeter (DSC, produced by SEIKO DENSHI KOGYO Co., Ltd.).

Formula (V)

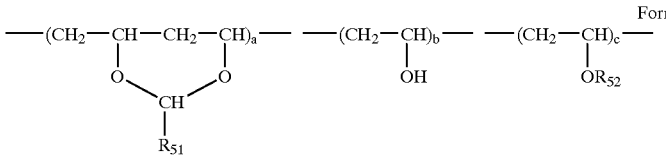

| Polymer | $R_{51}$ $CH_3$ (mol %) | $R_{51}$ $C_3H_7$ (mol %) | a Total Acetal | c ($R_{52}$) $CH_3CO$ (mol %) | b Hydroxy (mol %) | Tg (° C.) |
|---|---|---|---|---|---|---|
| P-1 | 60 | 40 | 73.7 | 1.7 | 24.6 | 83 |
| P-2 | 30 | 70 | 75.0 | 1.6 | 23.4 | 75 |
| P-3 | 100 | 0 | 73.6 | 1.9 | 24.5 | 104 |
| P-4 | 70 | 30 | 71.1 | 1.6 | 27.3 | 88 |
| P-5 | 90 | 10 | 71.8 | 1.5 | 26.7 | 99 |
| P-6 | 80 | 20 | 71.4 | 1.6 | 27.0 | 90 |
| P-7 | 30 | 70 | 70.4 | 1.6 | 28.0 | 76 |
| P-8 | 30 | 70 | 77.4 | 1.6 | 21.0 | 74 |
| P-9 | — | — | — | — | — | 60 |

P-9 described above is polyvinyl butyral resin B-79 (available from SORCIA Co.).

Photothermographic imaging materials of the invention, which form photographic images on thermal development, comprises a reducible silver source (such as organic silver salts), light sensitive silver halide grains, a reducing agent, and optionally a color toning agent for modifying silver image color tone, which are contained in the form of a dispersion in a binder matrix. Exemplary preferred toning agents are described in RD17029, U.S. Pat. Nos. 4,123,282, 3,994,732, 3,846,136 and, 4,021,249. Specifically preferred toning agents include phthalazinone, a combination of phthalazine, and phthalic acids or phthalic acid anhydrides.

With regard to image tone of the outputted image used for medical diagnosis, it has been supposed that more exact diagnostic observation results can be easily achieved with cold image tone. The cold image tone refers to pure black tone or bluish black tone and the warm image tone refers to a brownish black image exhibiting a warm tone.

The expression regarding to the tone, i.e., "colder tone" or "warmer tone can be determined based on a hue angle, $h_{ab}$ at a density of 1.0, as defined in JIS Z 8729. The hue angle, $h_{ab}$ can be represented as $h_{ab}=\tan^{-1}(b^*/a^*)$ obtained from a XYZ color system, or tristimulus values X, Y and Z or $X_{10}$, $Y_{10}$ and $Z_{10}$ defined in JIS Z 8701, using color coordinates a* and b* in L*a*b* color system defined in JIS Z 8729. In the invention the range of the $h_{ab}$ is $190°<h_{ab}<260°$, preferably $195°<h_{ab}<255°$, and more preferably $200°<h_{ab}<250°$.

In the present invention, a matting agent is preferably incorporated into the surface layer of the photothermographic imaging material (on the light sensitive layer side or even in cases where a light insensitive layer is provided on the opposite side of the support to the light sensitive layer). In order to minimize the image abrasion after thermal development, the matting agent is provided on the surface of a photosensitive material and the matting agent is preferably incorporated in an amount of 1 to 30% by weight of the binder.

Materials of the matting agent employed in the invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The matting agent used in the invention preferably has an average particle diameter of 0.5 to 10 μm, and more preferably of 1.0 to 8.0 μm. Furthermore, the variation coefficient of the size distribution is preferably not more than 50%, is more preferably not more than 40%, and is still more preferably not more than 30%. The variation coefficient of the grain size distribution as described herein is a value represented by the following formula:

(standard deviation of particle size/average particle size)×100.

Addition methods of the matting agent include those in which a matting agent is previously dispersed into a coating composition and is then coated, and prior to the completion of drying, a matting agent is sprayed. When plural matting agents are added, both methods may be employed in combination.

Suitable supports used in the photothermographic imaging materials of the invention include various polymeric materials, glass, wool cloth, cotton cloth, paper, and metals (such as aluminum). Flexible sheets or roll-convertible one are preferred. Examples of preferred support used in the invention include plastic resin films such as cellulose acetate film, polyester film, polyethylene terephthalate film, polyethylene naphthalate film, polyamide film, polyimide film, cellulose triacetate film and polycarbonate film, and biaxially stretched polyethylene terephthalate (PET) film is specifically preferred. The support thickness is 50 to 300 μm, and preferably 70 to 180 μm.

To improve electrification properties of photothermographic imaging materials, metal oxides and/or conductive compounds such as conductive polymers may be incorporated into the constituent layer. These compounds may be incorporated into any layer and preferably into a sublayer, a backing layer, interlayer between the light sensitive layer and the sublayer. Conductive compounds described in U.S. Pat. No. 5,244,773, col. 14–20.

The photothermographic material of the invention comprises at least one light-sensitive layer on the support, and further thereon, preferably having a light-insensitive layer. For example, a protective layer is provided on the light-sensitive layer. On the opposite side of the support to the light-sensitive layer, a back coating layer is preferably provided to protect the light-sensitive layer or prevent adhesion. Binders used in the protective layer or back coating layer are preferably selected from polymers which have a glass transition point higher than that of the thermally developable layer and are hard to cause abrasion or deformation, such as cellulose acetate and cellulose acetate-butylate. To adjust contrast, two or more light-sensitive layers may be provided on one side of the support, or one or more layers may be provided on both sides of the support.

It is preferred to form a filter layer on the same side as or on the opposite side to the light sensitive layer or to allow a dye or pigment to be contained in the light sensitive layer to control the amount of wavelength distribution of light transmitted through the light sensitive layer of photothermographic imaging materials relating to the invention. Commonly known compounds having absorptions in various wavelength regions can used as a dye, in response to spectral sensitivity of the photothermographic material.

In cases where the photothermographic imaging material relating to the invention are applied as a image recording material using infrared light is preferred the use of squarilium dye containing a thiopyrylium nucleus (also called as thiopyrylium squarilium dye), squarilium dye containing a pyrylium nucleus (also called as pyrylium squarilium dye), thiopyrylium chroconium dye similar to squarilium dye or pyrylium chroconium. The compound containing a squarilium nucleus is a compound having a 1-cyclobutene-2-hydroxy-4one in the molecular structure and the compound containing chroconium nucleus is a compound having a 1-cyclopentene-2-hydroxy, 4,5-dione in the molecular structure, in which the hydroxy group may be dissociated. Hereinafter, these dyes are collectively called a squarilium dye. Compounds described in JP-A 8-201959 are also preferably usable as a dye.

In one preferred embodiment of the invention, plural coating solutions are simultaneously coated to form multilayers and then subjected to a heating treatment. Thus, coating solutions for respective constituent layers (for example, light-sensitive layer, protective layer) and coating and drying are not repeated for respective layers but plural layers are simultaneously coated and dried to form respective constituent layers. The upper layer is provided before the remaining amount of total solvents in the lower layer reaches 70% or less.

Methods for simultaneously coating plural constituent layers are not specifically limited and commonly known methods, such as a bar coating method, curtain coating method, air-knife method, hopper coating method and extrusion coating method are applicable. Of these, extrusion coating, that is, pre-measuring type coating is preferred. The extrusion coating is suitable for accurate coating or organic solvent coating since no evaporation occur on the slide surface, as in a slide coating system. This coating method is applicable not only to the light-sensitive layer side but also to the case when simultaneously coating a backing layer with the sublayer.

In the invention, a total silver coverage, which is dependent of the object of the photothermographic imaging material is optionally selected. In cases where intended to use images for medical check, the total silver coverage is preferably 0.6 to 2.5 g/m$^2$, and more preferably 1.0 to 1.7 g/m$^2$. Of the total silver coverage, a silver coverage of silver halide preferably account for 2 to 18%, and more preferably 3 to 15% of the total silver coverage. The coating density of silver halide grains having a circular equivalent diameter of 0.01 $\mu$m or more is not less than $1\times10^{14}$ grains/m$^2$, and preferably not less than $1\times10^{17}$ grains/m$^2$. The coating density of an aliphatic carboxylic acid silver salt is $10^{-17}$ to $10^{-15}$ g, and preferably $10^{-16}$ to $10^{-14}$ g per grain having a circular equivalent diameter of 0.01 $\mu$m or more. Coating within the foregoing range leads to preferred results in terms of an optical maximum density of silver images per a given silver coverage, that is, silver covering amount (i.e., covering power) and silver image tone.

The developing conditions for photographic materials are variable, depending on the instruments or apparatuses used, or the applied means and typically accompany heating the imagewise exposed photothermographic imaging material at an optimal high temperature. Latent images formed upon exposure are developed by heating the photothermographic material at an intermediate high temperature (ca. 80 to 200° C., and preferably 100 to 200° C.) over a period of ample time (generally, ca. 1 sec. to ca. 2 min.). Sufficiently high image densities cannot be obtained at a temperature lower than 80° C. and at a temperature higher than 200° C., the binder melts and is transferred onto the rollers, adversely affecting not only images but also transportability or the thermal processor. An oxidation reduction reaction between an organic silver salt (functioning as an oxidant) and a reducing agent is caused upon heating to form silver images. The reaction process proceeds without supplying any processing solution such as water from the exterior.

In the invention, the developing temperature is preferably 100 to 200° C.

Heating instruments, apparatuses and means include typical heating means such as a hot plate, hot iron, hot roller or a heat generator employing carbon or white titanium. In the case of a photothermographic imaging material provided with a protective layer, it is preferred to thermally process while bringing the protective layer side into contact with a heating means, in terms of homogeneous-heating, heat efficiency and working property. It is also preferred to conduct thermal processing while transporting, while bringing the protective layer side into contact with a heated roller.

Exposure of photothermographic imaging materials desirably uses a light source suitable to the spectral sensitivity of the photothermographic materials. An infrared-sensitive photothermographic material, for example, is applicable to any light source in the infrared light region but the use of an infrared semiconductor laser (780 nm, 820 nm) is preferred in terms of being relatively high power and transparent to the photothermographic material.

In the invention, exposure is preferably conducted by laser scanning exposure and various methods are applicable to its exposure. One of the preferred embodiments is the use of a laser scanning exposure apparatus, in which scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 $\mu$m, and more preferably not more than 100 $\mu$m. Thus, the smaller spot diameter preferably reduces the angle displaced from verticality of the laser incident angle. The lower limit of the beam spot diameter is 10 μm. The thus configured laser scanning exposure can reduce deterioration in image quality due to reflected light, such as occurrence of interference fringe-like unevenness.

In the second preferred embodiment of the invention, exposure applicable in the invention is conducted preferably using a laser scanning exposure apparatus producing longitudinally multiple scanning laser light, whereby deterioration in image quality such as occurrence of interference fringe-like unevenness is reduced, as compared to scanning laser light with longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

In the first, second and third preferred embodiments of the image recording method of the invention, lasers for scanning exposure used in the invention include, for example, solid-state lasers such as ruby laser, YAG laser, and glass laser; gas lasers such as He—Ne laser, Ar laser, Kr ion laser, $CO_2$ laser, Co laser, He—Cd laser, $N_2$ laser and eximer laser; semiconductor lasers such as InGa laser, AlGaAs laser, GaAsP laser, InGaAs laser, InAsP laser, $CdSnP_2$ laser, and GSb laser; chemical lasers; and dye lasers. Of these, semiconductor lasers of wavelengths of 600 to 1200 nm are preferred in terms of maintenance and the size of the light source. When exposed onto the photothermographic imaging material in the laser imager or laser image-setter, the beam spot diameter on the exposed surface is 5 to 75 μm as a minor axis diameter and 5 to 100 μm as a major axis diameter. The laser scanning speed is set optimally for each photothermographic material, according to its sensitivity at the laser oscillation wavelength and the laser power.

EXAMPLES

The present invention will be further described based on examples but embodiments of the invention are by no means limited to these examples.

Example 1

Preparation of Photographic Support

On one side of blue-tinted polyethylene terephthalate film (having a thickness of 175 μm) exhibiting a density of 0.170 which was previously subjected to a corona discharge treatment at 0.5 kV·A·min/m$^2$, sublayer A was coated using the following sublayer coating solution A-1 so as to have a dry layer thickness of 0.2 μm. After the other side of the film was also subjected to a corona discharge treatment at 0.5 kV·A·min/m$^2$, sub-layers B and A were coated thereon using sublayer coating solutions B and A described below so as to have dry layer thickness of 0.1 and 0.2 μm, respectively. Thereafter, a heating treatment was conducted at 130° C. for 15 min in a heating treatment type oven having a film transport apparatus provided with plural rolls.

Sub-coating Solution A

Copolymer latex solution (30% solids) of 270 g, comprised of 30% by weight of n-butyl acrylate, 20% by weight of t-butyl acrylate, 25% by weight of styrene and 25% by weight of 2-hydroxyethyl acrylate was mixed with 0.6 g of compound (UL-1) and 1 g of methyl cellulose. Further thereto a dispersion in which 1.3 g of silica particles (SILOID, available from FUJI SYLYSIA Co.) was previously dispersed in 100 g of water by a ultrasonic dispersing machine, Ultrasonic Generator (available from ALEX Corp.) at a frequency of 25 kHz and 600 W for 30 min., was added and finally water was added to make 100 ml to form sub-coating solution A.

Preparation of Colloidal Tin Oxide Dispersion

Stannic chloride hydrate of 65 g was dissolved in 2000 ml of water/ethanol solution. The prepared solution was boiled to obtain co-precipitates. The purified precipitate was taken out by decantation and washed a few times with distilled water. To the water used for washing, aqueous silver nitrate was added to confirm the presence of chloride ions. After confirming no chloride ion, distilled water was further added to the washed precipitate to make the total amount of 2000 ml. After adding 40 ml of 30% ammonia water was added and heated, heating was further continued and concentrated to 470 ml to obtain a colloidal tin oxide dispersion.

Sub-coating Solution B

The foregoing colloidal tin oxide dispersion of 37.5 g was mixed with 3.7 g of copolymer latex solution (30% solids) comprised of 20% by weight of n-butyl acrylate, 30% by weight of t-butyl acrylate, 27% by weight of styrene and 28% by weight of 2-hydroxyethyl acrylate, 14.8 g of copolymer latex solution (30% solids) comprised of 40% by weight of n0butyl acrylate, 20% by weight of styrene and 40% by weight of glycidyl methacrylate, and 0.1 g of surfactant UL-1 (as a coating aid) and water was further added to make 1000 ml to obtain sub-coating solution B.

UL-1

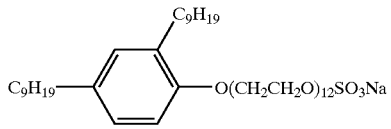

Back Layer-side Coating

Back Layer Coating Solution

To 830 g of methyl ethyl ketone (MEK), 84.2 g of cellulose acetate-butyrate (CAB381-20, available from Eastman Chemical Co.) and 4.5 g of polyester resin (Vitel PE2200B, available from Bostic Corp.) were added and dissolved. To the resulting solution were added 0.30 g of infrared dye 1 and further thereto, 4.5 g fluorinated surfactant (SURFLON KH40, available from Asahi Chemical Ind. Co., Ltd.) and 2.3 g of a fluorinated surfactant (MEGAFAC F120K, available from Dainippon Ink Co., Ltd.) which were previously dissolved in 43.2 g of methanol, were added with sufficiently stirring until being dissolved. To the resulting solution was added 75 g of silica particles (SYLOID 64×6000, available from W. R. Grace Co.), which were previously added to methyl ethyl ketone in a concentration of 1% by weight to prepare a coating solution for the backing layer side.

Infrared Dye 1

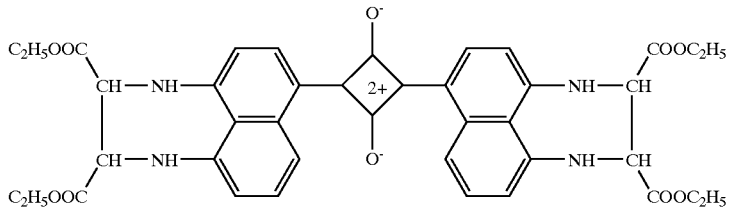

The thus prepared coating solutions were each coated on the support using an extrusion coater and dries so as to form a dry layer of 3.5 μm. Drying was conducted at a dry bulb temperature of 100° C. and a dew point of 10° C. over a period of 5 min.

| Preparation of Light-Sensitive Silver Halide Emulsion | |
|---|---|
| Solution A1 | |
| Phenylcarbamoyl gelatin | 88.3 g |
| Compound A* (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |
| Solution E1 | |
| 0.4 mol/l aqueous potassium bromide solution Amount necessary to adjust silver potential | |
| Solution E1 | |
| Potassium hydroxide | 0.71 g |
| Water to make | 20 ml |
| Solution G1 | |
| Aqueous 56% acetic acid solution | 18 ml |
| Solution H1 | |
| Anhydrous sodium carbonate | 1.72 g |
| Compound (A) $HO(CH_2CH_2O)_n—(CH(CH_3)CH_2O)_{17}—CH_2CH_2O)_mH$ (m + n = 5 to 7) | |

Using a stirring mixer described in JP-B Nos. 58-58288, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto, while the pAg was adjusted using solution E1. After 6 min, ¾ of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 liters water with stirring, the silver halide emulsion was again coagulated. Remaining 1500 ml of precipitates, the supernatant was removed and after adding 10 liters water with stirring, the silver halide emulsion was again coagulated. Remaining 1500 ml of precipitates, the supernatant was removed and solution H1 was added. The temperature was raised to 60° C. and stirring continued for 120 min. Finally, the pH was adjusted to 5.8 and water was added there to so that the weight per mol of silver was 1161 g, and light-sensitive silver halide emulsion B-3 was thus obtained.

It was proved that the resulting emulsion was comprised of monodisperse silver iodobromide cubic grains having an average grain size of 0.040 μm, a coefficient of variation of grain size of 12% and a [100] face ratio of 92%.

To the thus prepared emulsion was added 240 ml of sulfur sensitizer S-5 (0.5% methanol solution), further thereto, gold sensitizer Au-5 was added in an amount equivalent to 1/20 mol of the sulfur sensitizer and the emulsion was subjected to chemical sensitization at a temperature of 55° C. for a period of 120 min. with stirring. The thus obtained emulsion was designated as light sensitive silver halide emulsion A.

Preparation of Powdery Fatty Acid Silver Salt A

Behenic acid of 130.8 g, arachidic acid of 67.7 g, stearic acid of 43.6 g and palmitic acid of 2.3 g were dissolved in 4720 ml of water at 90° C. Then, 540.2 ml of aqueous 1.4 mol/l NaOH was added, and after further adding 6.9 ml of concentrated nitric acid, the mixture was cooled to 55° C. to obtain a fatty acid sodium salt solution. To the thus obtained fatty acid sodium salt solution, 45.3 g of light-sensitive silver halide emulsion A obtained above and 450 ml of water were added and stirred for 5 min., while being maintained at 55° C. Subsequently, 702.6 ml of 1M aqueous silver nitrate solution was added in 2 min. and stirring continued further for 10 min. to obtain a dispersion of fatty acid silver salt. Thereafter, the thus obtained dispersion was transferred to a washing vessel and washing with deionized water and filtration were repeated until the filtrate reached a conductivity of 2 μS/cm. Using a flush jet dryer (produced by Seishin Kigyo Co., Ltd.), the thus obtained cake-like organic silver salt was dried under an atmosphere of nitrogen gas, according to the operation condition of a hot air temperature at the inlet of the dryer until reached a moisture content of 0.1% to obtain dried powdery organic silver salt A. The moisture content was measured by an infrared ray aquameter.

Preparation of Pre-dispersing Solution A

In 1457 g MEK was dissolved 14.57 g of polyvinyl butyral resin P-9 and further thereto was gradually added 500 g of the powdery fatty acid silver salt A to obtain pre-dispersion B-3, while stirring by a dissolver type homogenizer (DISPERMAT Type CA-40, available from VMA-GETZMANN) to obtain a pre-dispersing solution A.

Preparation of Light-sensitive Dispersion A

Thereafter, using a pump, the pre-dispersion A was transferred to a media type dispersion machine (DISPERMAT Type SL-C12 EX, available from VMA-GETZMANN), which was packed 1 mm Zirconia beads (TORESELAM, available from Toray Co. Ltd.) by 80%, and dispersed at a circumferential speed of 8 m/s and for 1.5 min. of a retention time with a mill to obtain light-sensitive dispersion A.

Preparation of Stabilizer Solution

In 4.97 g methanol were dissolved 1.0 g of Stabilizer 1 and 0.31 g of potassium acetate to obtain stabilizer solution.

Preparation of Infrared Sensitizing Dye Solution A

In 31.3 ml MEK were dissolved 19.2 mg of infrared sensitizing dye 1, 1.488 g of 2-chlorobenzoic acid, 2.779 g of Stabilizer-2 and 365 mg of 5-methyl-2-mercaptobenzimidazole in a dark room to obtain an infrared sensitizing dye solution A.

Preparation of Additive Solution a

In 110 g MEK were dissolved 27.98 g of exemplified developer 1-14, 1.54 g of 4-methylphthalic acid and 0.48 g of the infrared dye-1 to obtain additive solution a.

Preparation of Additive Solution b 2 g of antifoggant 2 was dissolved in 40.9 g MEK to obtain additive solution b.

Preparation of Light-sensitive Layer Coating Solution A

Under inert gas atmosphere (97% nitrogen), 50 g of the light-sensitive emulsion A and 15.11 g MEK were maintained at 21° C. with stirring, and 390 μm of antifoggant 1 (10% methanol solution) was added and stirred for 1 hr. Further thereto, 494 μl of calcium bromide (10% methanol solution) was added and stirred for 20 min. Subsequently, 167 ml of the stabilizer solution was added and after stirring for 10 min., 1.32 g of the foregoing infrared sensitizing dye solution was added and stirred for 1 hr. Then, the mixture was cooled to 13° C. and stirred for 30 min. Further thereto, 13.31 g of polyvinyl butyral P-1 was added and stirred for 30 min, while maintaining the temperature at 13° C., and 1.084 g of tetrachlorophthalic acid (9.4% MEK solution) and stirred for 15 min. Then, 12.43 g of additive solution a, 1.6 ml of 10% MEK solution of Desmodur N3300 (aliphatic isocyanate, available from Movey Co.) and 4.27 g of additive solution b were successively added with stirring to obtain coating solution A of the light-sensitive layer.

Preparation of Matting Agent Dispersion

In 42.5 g of methyl ethyl ketone, 75 g of cellulose acetate-butyrate (CAB171-15, available from Eastman Chemical Co.) was dissolved and further thereto, 5 g of calcium carbonate (Super-Pflex 200, available from Specificality Mineral Co.) was added and dispersed with stirring and by a dissolver type stirrer at 8000 rpm for 30 min. to obtain a matting agent-dispersing solution.

Preparation of Surface Protective Layer Coating Solution

In 865 g MEK were dissolved with stirring 96 g of cellulose acetate-butyrate (CAV 171-15), 4.5 g of polymethyl methacrylic acid (Paraloid A-21, Rohm & Haas Co.). 4.5 g of vinylsulfone compound, 1.0 g of benztriazole and 1.0 g of fluorinated surfactant (Surflon KH 40, available Asahi Chemical Ind. Co., Ltd.). Then, 30 g of the matting agent dispersion was added with stirring to obtain a coating solution of the surface protective layer.

S-1

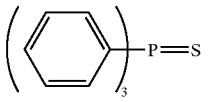

Au-5

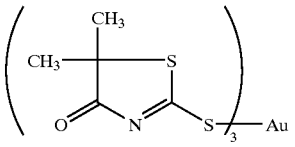

Stabilizer 1

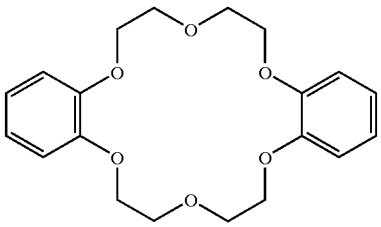

Antifoggant 1

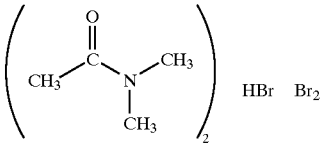

Stabilizer 2

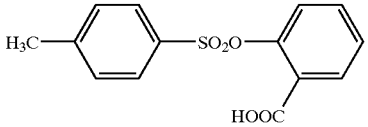

Antifoggant 2

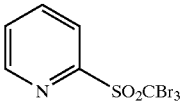

VSC

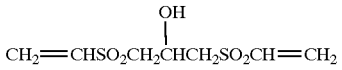

-continued

Infrared Dye 1

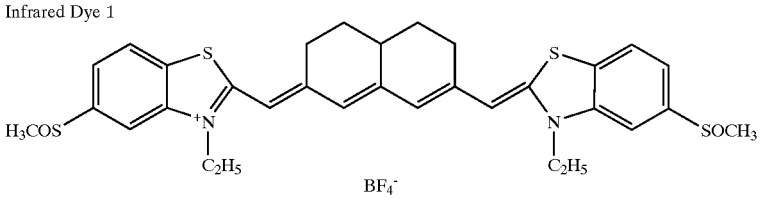

Preparation of Photothermographic Material Sample 101

Using a commonly known extrusion type coater, the thus prepared light-sensitive layer coating solution A and protective layer coating solution were simultaneously coated on the support having coated on the back side in the order of the light-sensitive layer and protective layer to prepare sample 101. The silver coating amount of the light-sensitive layer was 1.0 g/m$^2$ and the dry layer thickness of the protective layer was 2.5 $\mu$m. Drying was conducted using hot air at a dry bulb temperature of 75° C. and a dew point of 10° C. for 10 min.

Samples 102 through 123 were prepared similarly to Sample 101, provided that after addition of the additive solution "b" in the process of preparing the light-sensitive layer coating solution A, compounds represented by formulas (1) to (3) was added in amount of 1.0 g of a 1% methanol solution and the cross-linking agent of aliphatic isocyanate was changed as shown in Table 1.

Exposure and Processing

The thus prepared photothermographic material samples were each subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° of an angle between the exposed surface and exposing laser light. The exposed photothermographic material was subjected to thermal development at 123° C. for 13.5 sec., using a modified Dry Pro 722 (available from Konica Corp.), while bringing the protective layer surface of the photothermographic material into contact with the heated drum surface. Exposure and thermal development were carried out in an atmosphere of 23° C. and 50% RH. Thus obtained images were subjected to densitometry using a densitometer. Samples were evaluated with respect to sensitivity, fog density and maximum density. The sensitivity was represented by a relative value of the reciprocal of exposure giving a density of 1.0 plus an unexposed area density, based on the sensitivity of Sample 101 being 100.

Evaluation of Storage Stability

Two hermetically sealed vessels were prepared, in which samples were placed in an atmosphere of 25° C. and 55% RH. One of the vessel was allowed to stand at 50° C. for 7 days (hereinafter, also denoted as accelerated aging samples). The other one was allowed to stand at 25° C. for 7 days (hereinafter, also denoted as reference samples).

The thus aged samples and reference samples for comparison were subjected to the foregoing exposure and processing, and determined with respect to variation rates of minimum and maximum densities to evaluate storage stability.

(1) Variation Rate of Minimum Density ($D_{min}$)

The minimum density of each of accelerated aging samples (denoted as D2) and that of reference samples (denoted as D1) were measured and a variation rate of minimum density (expressed in %) was determined according to the following equation:

$$D_{min} \text{ variation rate } (\%) = (D2/D1) \times 100$$

(2) Variation Rate of Maximum Density ($D_{max}$)

Similarly to the determination of the minimum density variation rate described above, the variation rate of maximum density was determined according to the following equation:

$$D_{max} \text{ variation rate } (\%) = (D_{max} \text{ of accelerated aging sample/reference sample}) \times 100.$$

TABLE 1

| Sample No. | Compound | Aromatic Isocyanate | Fog | Sensitivity | Maximum Density (relative value) | Storage Stability $D_{min}$ Variation Rate (%) | Storage Stability $D_{max}$ Variation Rate (%) | Remark |
|---|---|---|---|---|---|---|---|---|
| 101 | | — | 0.225 | 100 | 100 | 149 | 83 | Comp. |
| 102 | 1-3 | — | 0.231 | 101 | 166 | 165 | 51 | Comp. |
| 103 | 1-14 | — | 0.229 | 99 | 172 | 163 | 53 | Comp. |
| 104 | 1-42 | — | 0.232 | 96 | 164 | 168 | 56 | Comp. |
| 105 | 2-1 | — | 0.243 | 91 | 159 | 167 | 48 | Comp. |
| 106 | 2-11 | — | 0.211 | 106 | 175 | 159 | 50 | Comp. |
| 107 | 2-14 | — | 0.212 | 103 | 173 | 165 | 47 | Comp. |
| 108 | 3-2 | — | 0.209 | 103 | 159 | 189 | 51 | Comp. |
| 109 | 3-3 | — | 0.207 | 100 | 168 | 193 | 53 | Comp. |
| 110 | 1-3 | IH-1 | 0.197 | 107 | 171 | 140 | 97 | Inv. |
| 111 | 1-14 | IH-1 | 0.195 | 110 | 177 | 138 | 95 | Inv. |
| 112 | 1-42 | IH-1 | 0.203 | 110 | 169 | 143 | 93 | Inv. |
| 113 | 2-1 | IH-1 | 0.206 | 113 | 164 | 142 | 95 | Inv. |
| 114 | 2-11 | IH-1 | 0.209 | 105 | 180 | 132 | 98 | Inv. |

TABLE 1-continued

| Sample No. | Compound | Aromatic Isocyanate | Fog | Sensitivity | Maximum Density (relative value) | Storage Stability $D_{min}$ Variation Rate (%) | Storage Stability $D_{max}$ Variation Rate (%) | Remark |
|---|---|---|---|---|---|---|---|---|
| 115 | 2-14 | IH-1 | 0.182 | 110 | 178 | 140 | 96 | Inv. |
| 116 | 3-2 | IH-1 | 0.225 | 100 | 164 | 147 | 83 | Inv. |
| 117 | 3-3 | IH-1 | 0.231 | 101 | 173 | 151 | 84 | Inv. |
| 118 | 1-14 | IH-2 | 0.229 | 99 | 173 | 139 | 85 | Inv. |
| 119 | 2-11 | IH-2 | 0.232 | 96 | 176 | 133 | 87 | Inv. |
| 120 | 3-3 | IH-2 | 0.243 | 91 | 169 | 150 | 82 | Inv. |
| 121 | 1-14 | IH-3 | 0.211 | 106 | 174 | 138 | 94 | Inv. |
| 122 | 2-11 | IH-3 | 0.212 | 103 | 177 | 132 | 95 | Inv. |
| 123 | 3-3 | IH-3 | 0.209 | 103 | 170 | 151 | 94 | Inv. |

As apparent from Table 1, photothermographic material samples according to the invention exhibited enhanced sensitivity, reduced fogging and superior storage stability, compared to comparative samples.

Example 2

Silver salt photothermographic materials were prepared similarly to Example 1, except for the following.

Preparation of Powdery Fatty Acid Silver Salt B

Behenic acid of 104.6 g, arachidic acid of 54.2 g, stearic acid of 34.9 g and palmitic acid of 1.8 g were dissolved in 4720 ml of water at 80° C. Then, 432.2 ml of aqueous 1.5 mol/l NaOH was added, and after further adding 5.5 ml of concentrated nitric acid, the mixture was cooled to 55° C. to obtain a fatty acid sodium salt solution. To the thus obtained fatty acid sodium salt solution, 36.2 g of light-sensitive silver halide emulsion A obtained above and 450 ml of water were added and stirred for 5 min., while being maintained at 55° C. Subsequently, 562.1 ml of 1M aqueous silver nitrate solution was added in 2 min. and stirring continued further for 10 min. to obtain a dispersion of fatty acid silver salt. Thereinafter, similarly to preparation of fatty acid silver salt A in Example 1, powdery fatty acid silver salt B was prepared.

Preparation of Powdery Fatty Acid Silver Salt C

Behenic acid of 130.8 g, arachidic acid of 67.7 g, stearic acid of 43.6 g and palmitic acid of 2.3 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain a fatty acid sodium salt solution. To the thus obtained fatty acid sodium salt solution, 347 ml of t-butyl alcohol was added and then 45.3 g of light-sensitive silver halide emulsion A obtained above and 450 ml of water were added and stirred for 5 min., while being maintained at 55° C. Thereinafter, similarly to preparation of fatty acid silver salt A in Example 1, powdery fatty acid silver salt C was prepared.

Preparation of Powdery Fatty Acid Silver Salt D

Behenic acid of 130.8 g, arachidic acid of 67.7 g, stearic acid of 32.2 g and palmitic acid of 2.3 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain a fatty acid sodium salt solution. To the thus obtained fatty acid sodium salt solution, 347 ml of t-butyl alcohol was added and then 45.3 g of light-sensitive silver halide emulsion A obtained above and 450 ml of water were added and stirred for 5 min., while being maintained at 55° C. Thereinafter, similarly to preparation of fatty acid silver salt A in Example 1, powdery fatty acid silver salt D was prepared.

Preparation of Powdery Fatty Acid Silver Salt E

Behenic acid of 130.8 g, arachidic acid of 67.7 g, stearic acid of 37.6 g and palmitic acid of 2.3 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain a fatty acid sodium salt solution. To the thus obtained fatty acid sodium salt solution, 347 ml of t-butyl alcohol was added and then 45.3 g of light-sensitive silver halide emulsion A obtained above and 450 ml of water were added and stirred for 5 min., while being maintained at 55° C. Thereinafter, similarly to preparation of fatty acid silver salt A in Example 1, powdery fatty acid silver salt E was prepared.

Preparation of Powdery Fatty Acid Silver Salt F

Behenic acid of 130.8 g, arachidic acid of 67.7 g, stearic acid of 43.6 g, palmitic acid of 2.3 g and polyvinyl alcohol (PVA-205, available from KURARE Co., Ltd.) of 1.5 g were dissolved in 4720 ml of water at 80° C. Then, 540.2 ml of aqueous 1.5 mol/l NaOH was added, and after further adding 6.9 ml of concentrated nitric acid, the mixture was cooled to 55° C. to obtain a fatty acid sodium salt solution. To the thus obtained fatty acid sodium salt solution, 347 ml of t-butyl alcohol was added and then 45.3 g of light-sensitive silver halide emulsion A obtained above and 450 ml of water were added and stirred for 5 min., while being maintained at 55° C. Thereinafter, similarly to preparation of fatty acid silver salt A in Example 1, powdery fatty acid silver salt F was prepared.

Preparation of Pre-dispersing Solution B–F

Pre-dispersing solutions B through F were prepared similarly to Example 1, except that fatty acid silver salt A was replaced by the foregoing fatty acid silver salts B through F.

Preparation of Light-sensitive Dispersion B–F

Light-sensitive dispersion B through F were prepared similarly to Example 1, except that light-sensitive dispersion A was replaced by the foregoing light-sensitive dispersions B through F.

Preparation of Light-sensitive Layer Coating Solution B–F

Light-sensitive Layer Coating Solutions B through F were prepared similarly to Example 1, except that light-sensitive dispersion A was replaced by the foregoing light-sensitive dispersions B through F.

Preparation of Photothermographic Material

Similarly to Example 1, Sample 201 was prepared using light-sensitive layer coating solution B and the surface protective layer coating solution used in Example 1.

Samples 202 through 224 were prepared similarly to Sample 201, except that a light-sensitive dispersion used in the light-sensitive layer coating solution and an aromatic isocyanate compound were varied as shown in Table 2.

Determination of Grain Size and Thickness of Fatty Acid Silver Salt

After being dispersed, each of fatty acid silver salts B through F were diluted and dispersed on a grid provided with carbon supporting membrane and photographed using a transmission type electron-microscope of 5000 direct magnifications (Type 2000FX, available from NIPPON DENSHI Co. Ltd.). Using a scanner, the thus obtained negative images were read as digital images, and sizes of 300 grains were determined using an image processing apparatus (LUZE XIII, available from Nicore Co.) to obtain an average grain size.

In order to determine grain thickness, a light-sensitive layer coated on the support was adhered to a holder using an adhesive and cut vertical to the support using a diamond knife to obtain 0.1 to 0.2 thick, ultra-thin slices. The thus obtained ultra-thin slice was placed on a copper mesh and transferred onto a carbon membrane, hydrophilicity of which was previously enhanced with glow discharge. Using the transmission electron-microscope described above, bright field images were observed at 5,000 to 40,000 magnification with cooling to −130° C. or lower using liquid nitrogen and recorded onto photographic film. From the thus recorded images, 300 grains were measured with respect to thickness to determine an average grain thickness.

Exposure, processing and evaluation were conducted similarly to Example 1.

TABLE 2

| Sample No. | Compd.*1 | Compd.*2 | Dispersion.*3 | Ratio*4 | Fog | Sensitivity | Maximum Density (relative value) | Storage Stability $D_{min}$ Variation Rate (%) | Storage Stability $D_{max}$ Variation Rate (%) | Remark |
|---|---|---|---|---|---|---|---|---|---|---|
| 201 | — | — | A | 0.82/0.08 | 0.237 | 100 | 100 | 164 | 84 | Comp. |
| 202 | 1-14 | — | A | 0.82/0.08 | 0.245 | 115 | 170 | 177 | 54 | Comp. |
| 203 | 2-11 | — | A | 0.82/0.08 | 0.239 | 106 | 172 | 172 | 51 | Comp. |
| 204 | 3-3 | — | A | 0.82/0.08 | 0.249 | 108 | 164 | 204 | 54 | Comp. |
| 205 | 1-14 | IH-1 | A | 0.82/0.08 | 0.223 | 120 | 175 | 157 | 94 | Inv. |
| 206 | 2-11 | IH-1 | A | 0.82/0.08 | 0.220 | 116 | 177 | 152 | 98 | Inv. |
| 207 | 3-3 | IH-1 | A | 0.82/0.08 | 0.235 | 113 | 169 | 164 | 94 | Inv. |
| 208 | — | — | B | 0.77/0.06 | 0.240 | 108 | 106 | 163 | 86 | Comp. |
| 209 | 1-14 | — | B | 0.77/0.06 | 0.248 | 119 | 176 | 178 | 52 | Comp. |
| 210 | 2-11 | — | B | 0.77/0.06 | 0.242 | 112 | 178 | 173 | 53 | Comp. |
| 211 | 3-3 | — | B | 0.77/0.06 | 0.251 | 116 | 170 | 207 | 52 | Comp. |
| 212 | 1-14 | IH-1 | B | 0.77/0.06 | 0.226 | 124 | 181 | 156 | 95 | Inv. |
| 213 | 2-11 | IH-1 | B | 0.77/0.06 | 0.223 | 120 | 183 | 153 | 98 | Inv. |
| 214 | 3-3 | IH-1 | B | 0.77/0.06 | 0.238 | 117 | 175 | 162 | 95 | Inv. |
| 215 | — | — | C | 0.34/0.03 | 0.242 | 110 | 108 | 157 | 80 | Comp. |
| 216 | 1-14 | — | C | 0.34/0.03 | 0.250 | 121 | 179 | 172 | 48 | Comp. |
| 217 | 2-11 | — | C | 0.34/0.03 | 0.244 | 114 | 181 | 167 | 50 | Comp. |
| 218 | 3-3 | — | C | 0.34/0.03 | 0.253 | 118 | 173 | 203 | 49 | Comp. |
| 219 | 1-14 | IH-1 | C | 0.34/0.03 | 0.228 | 126 | 183 | 150 | 88 | Inv. |
| 220 | 2-11 | IH-1 | C | 0.34/0.03 | 0.225 | 122 | 185 | 142 | 94 | Inv. |
| 221 | 3-3 | IH-1 | C | 0.34/0.03 | 0.240 | 119 | 177 | 155 | 90 | Inv. |
| 222 | 2-11 | IH-1 | D | 0.42/0.03 | 0.223 | 128 | 187 | 147 | 96 | Inv. |
| 223 | 2-11 | IH-1 | E | 0.46/0.04 | 0.221 | 127 | 178 | 141 | 96 | Inv. |
| 224 | 2-11 | IH-1 | F | 0.48/0.04 | 0.214 | 125 | 176 | 148 | 95 | Inv. |

*1Compound of formula (1)–(3)
*2Aromatic isocyanate compound
*3Light-sensitive dispersion
*4Ratio of diameter to thickness (μm) of fatty acid silver salt As can be seen from Table 2, inventive photothermographic material samples exhibited superior storage stability as well as enhanced sensitivity and reduced fogging, as compared to comparative samples.

What is claimed is:

1. A photothermographic material comprising a light-insensitive aliphatic acid silver salt, a light-sensitive emulsion containing light-sensitive silver halide grains, a reducing agent for silver ions, a binder and a cross-linking agent, wherein the cross-linking agent is an aromatic polyisocyanate compound and the photothermographic material further comprises a compound selected from the compounds represented by the following formulas (1) through (3)

formula (1)

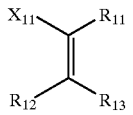

wherein $R_{11}$, $R_{12}$ and $R_{13}$ are each a hydrogen atom or a univalent substituent; $X_{11}$ is an electron-donating heterocyclic group, a cycloalkyloxy group, a cycloalkylthio group, a cycloalkylamino group or cycloalkenyl group;

formula (2)

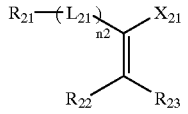

wherein $R_{21}$ is an alkyl group; $R_{22}$ and $R_{23}$ are each a hydrogen atom or a univalent substituent; $X_{21}$ is an ejection-withdrawing group; $L_{21}$ is an aromatic carbon-ring group; and n2 is 0 or 1;

formula (3)

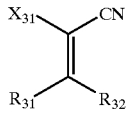

wherein $X_{31}$ is an electron-withdrawing heterocyclic group, a halogen atom or a haloalkyl group; one of $R_{31}$ and $R_{32}$ is a hydrogen atom and the other one is a hydroxy group.

2. The photothermographic material of claim 1, wherein $R_{11}$ in formula (1) is an electron-withdrawing group.

3. The photothermographic material of claim 1, wherein $R_{11}$ in formula (1) and $X_{21}$ in formula ($_2$) are a cyano group.

4. The photothermographic material of claim 1, wherein one of $R_{12}$ and $R_{13}$, or $R_{22}$ and $R_{23}$ is a hydrogen atom and the other one is an electron-donating group.

5. The photothermographic material of claim 1, wherein the aromatic polyisocyanate compound is represented by formula (Z):

$$(X_2{=}C{=}N{-}J_1)_{v2}{-}L{-}[J_1{-}(N{=}C{=}X_2)_{v1}]_n \qquad \text{formula (Z)}$$

wherein $J_1$ is an arylene group, or a heterocyclic group; L is a linkage group derived from an alkyl group, an alkenyl group, an aryl group or a heterocyclic group, or a linkage group formed by linking these groups through a bond or a linking group; $X_2$ is an oxygen atom or a sulfur atom; v1 is an integer of 1 or more, v2 is 0 or an integer of 1 or more, and n is an integer of 1 or more, provided that when v2 is 0, v1 or n is an integer of 2 or more.

6. The photothermographic material of claim 1, wherein the light-insensitive aliphatic acid silver salt is one which is formed in the presence of a compound capable of functioning as a crystal growth-retarding agent or a dispersing agent.

7. The photothermographic material of claim 6, wherein the compound capable of functioning as a crystal growth-retarding agent or a dispersing agent contains a hydroxy or carboxy group.

8. The photothermographic material of claim 1, wherein the aromatic polyisocyanate compound is a compound selected from the group consisting of the following compounds:

IH-1

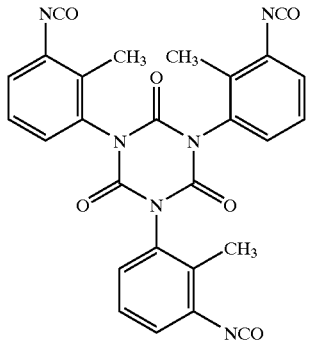

IH-2

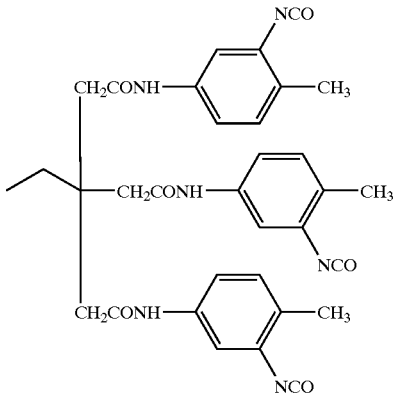

IH-3

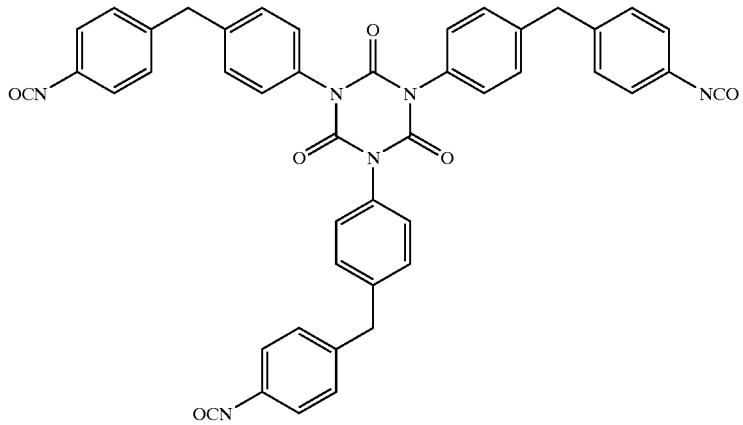

-continued
IH-4
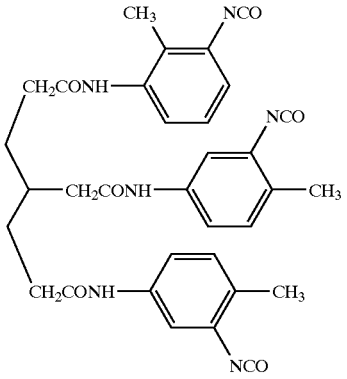
IH-5
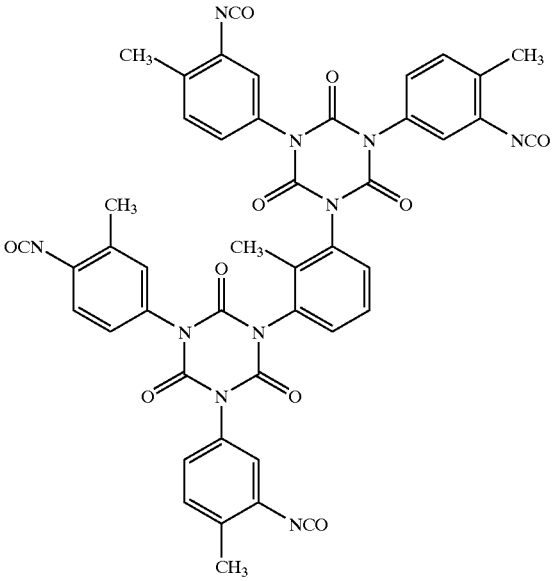
IH-6
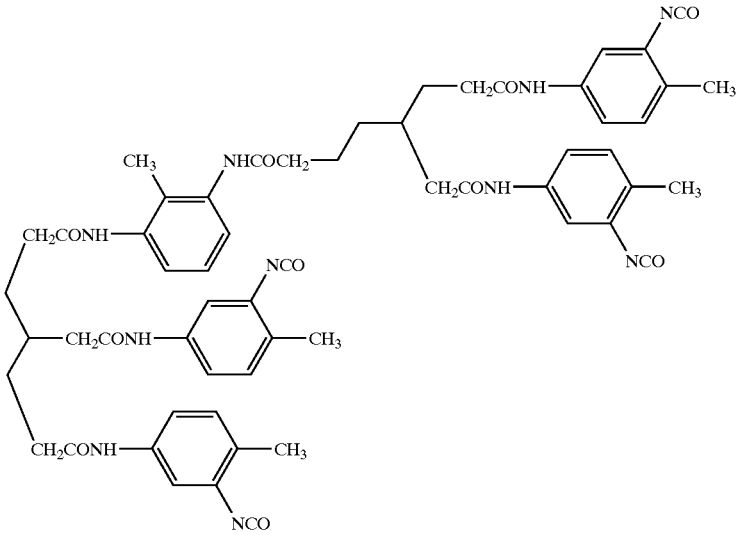
IH-7
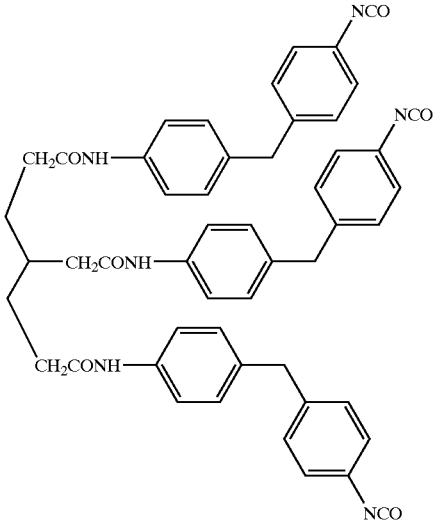

-continued
IH-8
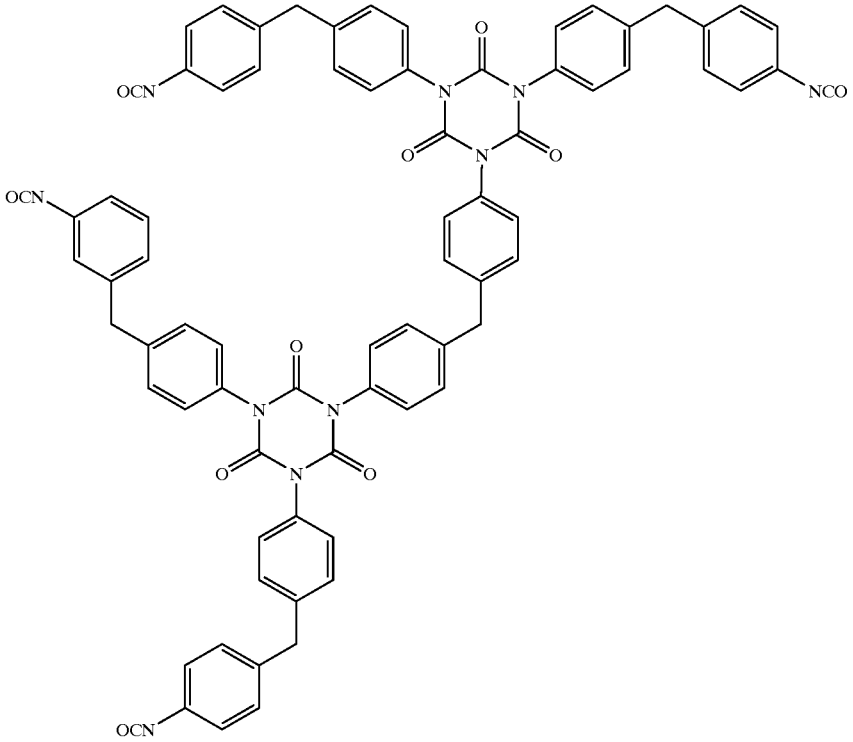
IH-9
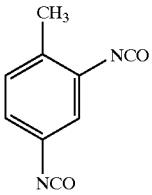
H-10
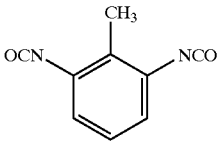
IH-11
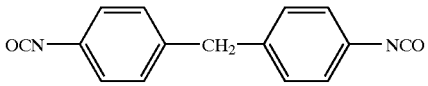
IH-12
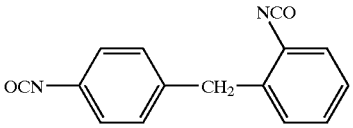
IH-13
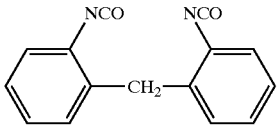
IH-14
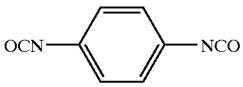
IH-15
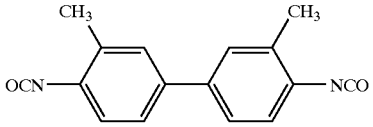
IH-16
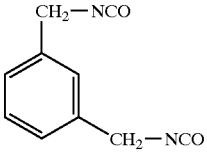
IH-17
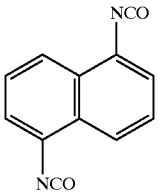
IH-18
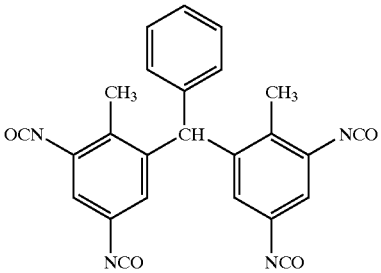

-continued

IH-19

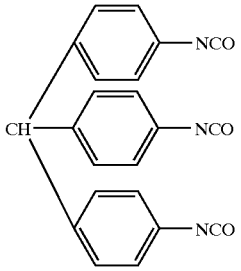

IH-20

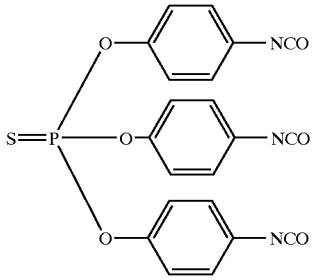

IH-21

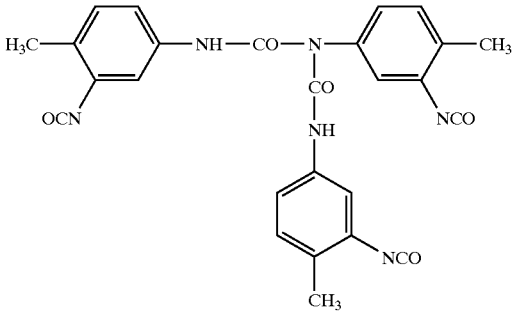

IH-22

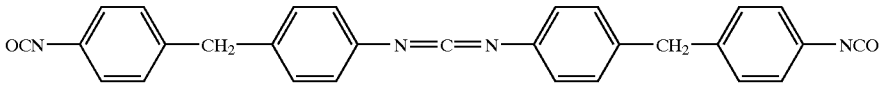

IH-23

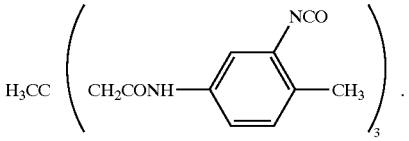

9. The photothermographic material of claim 1, wherein the electron-donating group represented by $X_{11}$ in formula (1) is one selected from the group consisting of a piperidynyl group, pyrrolidinyl group, morpholine group, piperazinyl group, 3-thienyl group, 2-furyl group, 3-furykl group and 2-pyrrolo group.

10. The photothermographic material of claim 1, wherein the alkyl group represented by $R_{21}$ in formula (2) is selected from the group consisting of methyl, ethyl, propyl isopropyl, butyl, pentyl, hexyl, heptyl and octyl.

* * * * *